US008613442B2

(12) United States Patent
Gamo et al.

(10) Patent No.: US 8,613,442 B2
(45) Date of Patent: Dec. 24, 2013

(54) SHEET STORING APPARATUS AND IMAGE FORMING APPARATUS

(75) Inventors: Yohei Gamo, Abiko (JP); Naoto Tokuma, Abiko (JP); Toshiyuki Iwata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/482,077

(22) Filed: May 29, 2012

(65) Prior Publication Data

US 2012/0313317 A1 Dec. 13, 2012

(30) Foreign Application Priority Data

Jun. 10, 2011 (JP) ..... 2011-130512
Jun. 15, 2011 (JP) ..... 2011-133567
May 14, 2012 (JP) ..... 2012-110524

(51) Int. Cl.
*B65H 31/08* (2006.01)

(52) U.S. Cl.
USPC ..... 271/212; 271/292; 271/293

(58) Field of Classification Search
USPC ..... 271/287, 292–295, 298, 299, 181, 177, 271/178, 180, 81, 212
See application file for complete search history.

(56) References Cited

U.S. PATENT DOCUMENTS 5,722,030 A 2/1998 Kato
7,874,553 B2 1/2011 Kushida et al.
2012/0275839 A1* 11/2012 Kushida et al. ..... 400/623
2012/0288310 A1* 11/2012 Kamiya et al. ..... 399/381
2012/0313313 A1* 12/2012 Momoka et al. ..... 271/3.19
2012/0313317 A1* 12/2012 Gamo et al. ..... 271/225
2012/0319346 A1* 12/2012 Iwata et al. ..... 271/3.14

* cited by examiner

*Primary Examiner* — Michael McCullough
(74) *Attorney, Agent, or Firm* — Fitzpatrick, Cella, Harper & Scinto

(57) ABSTRACT

A conveying roller conveys a sheet. A sheet holding portion receives a sheet from below and holds the received sheet with keeping its forward end upward and its rear end downward. The sheet holding portion has: a storing guide provided in a vertical state and having a guide surface configured to guide the received sheet upward; a conveying guide provided to face the guide surface and having a curved surface portion whose distance from the guide surface increases in the upward direction; and a holding member provided between the guide surface and the curved surface portion and configured to roll on the curved surface portion toward the guide surface to nip the received sheet with the guide surface. An inclination angle of the curved surface portion with respect to the guide surface decreases with distance from the guide surface.

20 Claims, 24 Drawing Sheets

SHEET STORING APPARATUS AND IMAGE FORMING APPARATUS

BACKGROUND OF THE INVENTION

1. Field of the Invention

The present invention relates to a sheet storing apparatus and an image forming apparatus, and particularly to an image forming apparatus above which a sheet storing apparatus is disposed.

2. Description of the Related Art

An image forming apparatus having a sheet storing apparatus is conventionally known. The sheet storing apparatus is provided for storing a sheet discharged from the image forming apparatus body, and sheets on which an image is formed are sequentially discharged to the sheet storing apparatus. For example, U.S. Pat. No. 5,722,030 discloses an image forming apparatus having a bin moving type sorter. In the sorter, a plurality of bin trays capable of storing a sheet on which an image is formed is so provided as to be movable in a vertical direction.

However, according to the sheet storing apparatus of the image forming apparatus disclosed in U.S. Pat. No. 5,722,030, the bin tray is provided in a substantially horizontal or a slightly inclined state, and sheets are sequentially laid out flat in the bin tray. Moreover, in order to improve distinguishability of the discharged sheet, the plurality of bin trays is provided in a stacked form and the bin tray used is changed depending on job discharging the sheet. Therefore, there is difference in height among the bin trays, which deteriorates visibility and removability of the sheet stored in the bin tray especially located at a low position.

Moreover, a sheet bundle discharged to the bin tray is not held in a bundle state, except for a case where the sheet bundle is stapled. Therefore, a sheet may be disordered in the bin tray due to a sheet condition (such as curl and skin friction) at the discharge, or the sheet bundle may erroneously touch another sheet bundle when removing it out of the bin tray. As a result, removability is deteriorated and trouble such as discharge error may be caused. Furthermore, the conventional sheet storing apparatus is placed on a side of the image forming apparatus, which causes a problem that a length in a width direction of a whole system including the image forming apparatus and the sheet storing apparatus is increased.

The present invention has been made in consideration of the above-described problems. The present invention provides a sheet storing apparatus that holds a sheet without dropping when storing the sheet in a vertical state to improve the visibility and removability of the sheet, and an image forming apparatus having the sheet storing apparatus.

SUMMARY OF THE INVENTION

A sheet storing apparatus according to an exemplary embodiment of the present invention has: a sheet conveying portion configured to convey a sheet discharged from an image forming portion which generates an image on a sheet; and a holding portion configured to receive a sheet conveyed by the sheet conveying portion from below and to hold the received sheet in a vertical state. The holding portion has: a first guide member provided in a vertical state and having a guide surface configured to guide the received sheet upward; a second guide member provided to face the guide surface of the first guide member and having an inclined portion, wherein an interval between the guide surface and the inclined portion increases in an upward direction; and a rolling member provided between the guide surface of the first guide member and the inclined portion of the second guide member and configured to roll on the inclined portion toward the guide surface to nip the received sheet with the guide surface.

According to the present invention, a sheet can be held with permitting sheet transit in a sheet conveying direction while restricting sheet movement in a direction opposite to the sheet conveying direction, which can improve the visibility and removability of the stored sheet.

Further features of the present invention will become apparent from the following description of exemplary embodiments with reference to the attached drawings.

DESCRIPTION OF THE EMBODIMENTS

Figure 1:
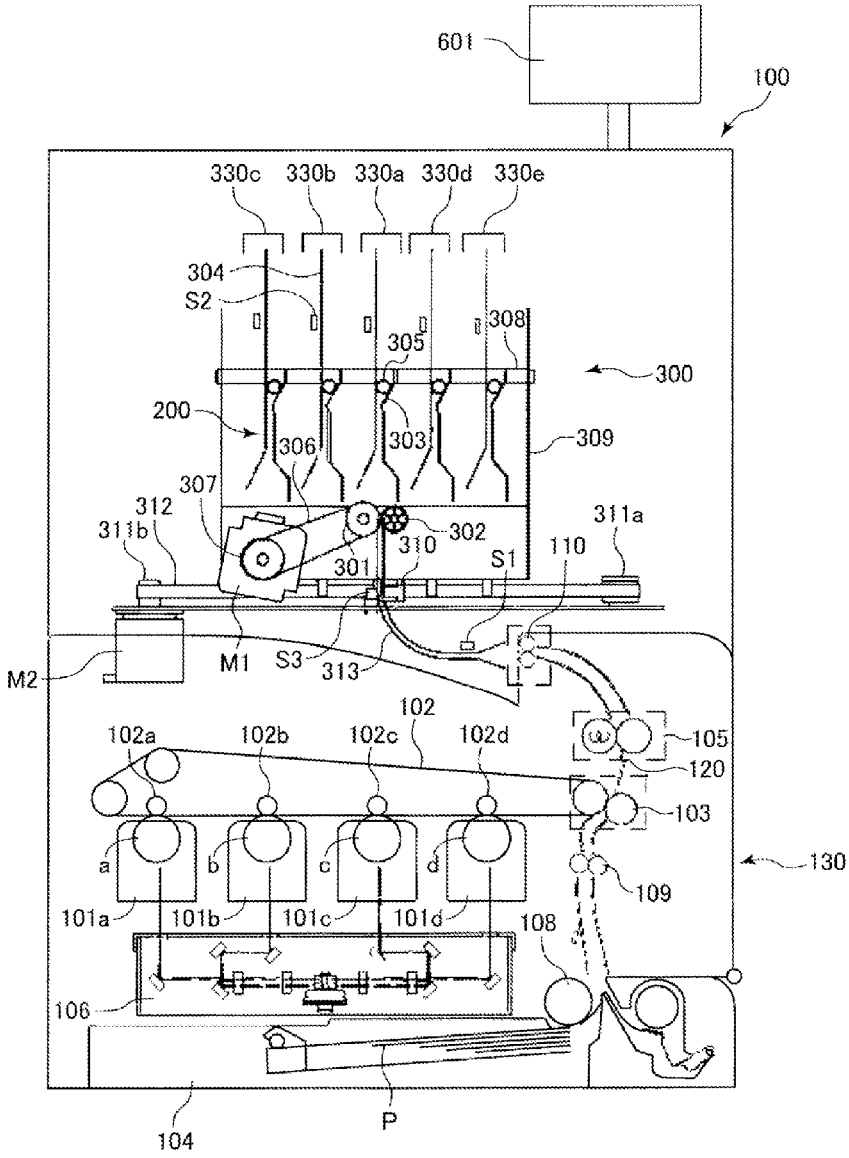
FIG. 1 is a cross-sectional view illustrating a copying machine as an image forming apparatus according to an exemplary embodiment of the present invention.

A sheet storing apparatus and an image forming apparatus having the sheet storing apparatus according to exemplary embodiments of the present invention will be described below with reference to FIGS. 1 to 14. It should be noted that numerical values in the description are just reference and do not limit the present invention. The same reference numerals are given to the same components, and an overlapping description will be omitted as appropriate.

First Exemplary Embodiment

A color copying machine 100 as an image forming apparatus according to an exemplary embodiment of the present invention will be described with reference to FIG. 1. The color copying machine 100 has a copying machine body 130 as an image forming apparatus body and a sheet storing apparatus 300 provided above and connected to the copying machine body 130. The color copying machine 100 has an image forming portion for forming an image (to be described later) and sheet storing portions 330*a* to 330*e* for storing a sheet P conveyed with the image formed by the image forming portion. Since use of the sheet storing apparatus 300 is optional, the copying machine body 130 is so configured as to be usable separately from the sheet storing apparatus 300. Alternatively, the sheet storing apparatus 300 and the copying machine body 130 may be integrally constructed.

[Image forming apparatus] Next, the copying machine body 130 will be described. The copying machine body 130 has a photosensitive drum a (yellow), a photosensitive drum b (magenta), a photosensitive drum c (cyan) and a photosensitive drum d (black) that are installed in parallel with each other and for forming yellow, magenta, cyan and black toner images, respectively. The photosensitive drums a to d are driven by motors (not shown), respectively. The copying machine body 130 further has an intermediate transfer belt 102 as a transfer conveying portion which is installed to intersect respective top portions of the photosensitive drums a to d.

A primary charger, a development device and a transfer charger (not shown) are provided around each of the photosensitive drums a to d, and respective sets are unitized as process cartridges 101*a* to 101*d*. An exposure device 106 having components such as a polygon mirror is installed below the photosensitive drums a to d. The photosensitive drums a to d, transfer charging members 102*a* to 102*d* (to be describe later) and the intermediate transfer belt 102 constitute the image forming portion according to the present exemplary embodiment.

A laser light corresponding to an image signal associated with a yellow component of a document is projected onto the photosensitive drum a through the polygon mirror and the like of the exposure device 106. As a result, an electrostatic latent image is formed on the photosensitive drum a. Then, a yellow toner is supplied from a development device and the electrostatic latent image is developed and visualized to be a yellow toner image (image). Due to rotation of the photosensitive drum a, the yellow toner image comes to a first transfer site where the photosensitive drum a and the intermediate transfer belt 102 abut with each other. Then, the yellow toner image on the photosensitive drum a is transferred to the intermediate transfer belt 102 by a first transfer bias applied to the transfer charging member 102*a* (first transfer).

The portion of the intermediate transfer belt 102 to which the yellow toner image is transferred moves to a position of the next image forming portion. By this time, a magenta toner image (image) is formed on the photosensitive drum b in a similar manner. Then, the magenta toner image is transferred to the intermediate transfer belt 102 to be superimposed on the yellow toner image. Similarly, the intermediate transfer belt 102 moves, and a cyan toner image and a black toner image are transferred to be superimposed on the yellow toner image and the magenta toner image at the first transfer sites of the respective image forming portions.

Moreover, a sheet cassette 104 for storing sheets P is installed at a bottom portion in the copying machine body 130. The sheets P stored in the sheet cassette 104 are fed one by one by a pick-up roller 108 that is provided above the sheet cassette 104 in a sheet feeding direction. The sheet P arrives at a second transfer site after the timing is adjusted by a registration roller 109. The four color toner images on the intermediate transfer belt 102 are transferred together to the sheet P by a second transfer bias applied to a pair of second transfer rollers 103 (second transfer).

The sheet P to which the four color toner images are transferred is guided by a conveying guide 120 to be conveyed to a pair of fixing rollers 105, where the sheet P is heated and pressured. As a result, toners of the respective colors are melted and mixed, and thus a full color print image is fixed on the sheet P. After that, the sheet P is discharged to the outside of the copying machine body 130 by a pair of discharge rollers 110 provided downstream of the pair of fixing rollers 105.

Figure 2:
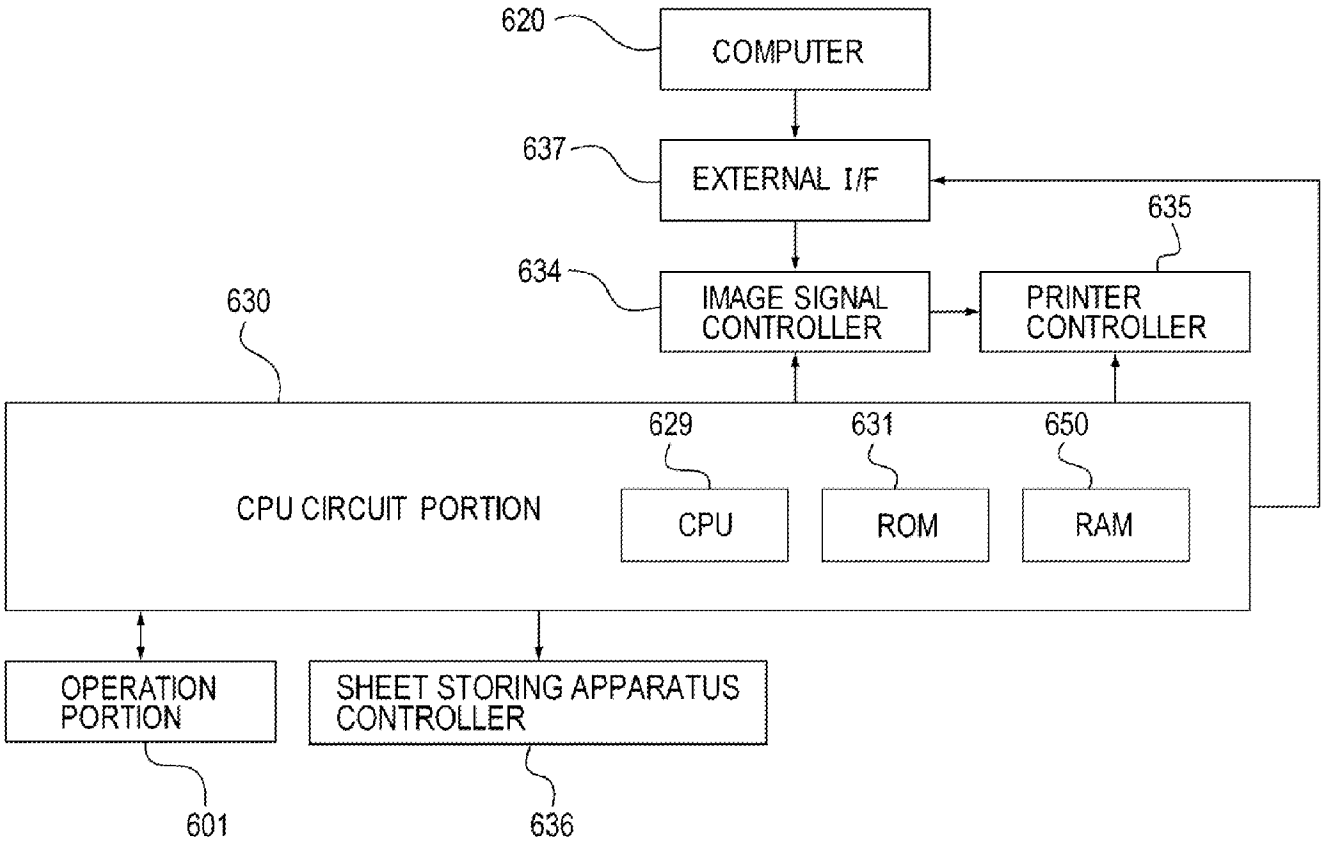
FIG. 2 is a block diagram illustrating a control system for controlling a copying machine body and a sheet storing apparatus according to an exemplary embodiment of the present invention.

FIG. 2 is a block diagram illustrating a control system for controlling the copying machine body 130 and the sheet storing apparatus 300 of the color copying machine 100. As shown in FIG. 2, the control system has a CPU circuit portion 630, and the CPU circuit portion 630 has a CPU 629, a ROM 631 and a RAM 650.

The CPU circuit portion 630 controls an image signal controller 634, a printer controller 635, a sheet storing apparatus controller (hereinafter referred to as a "storing apparatus controller") 636 and an external interface 637. The CPU circuit portion 630 performs the control in accordance with a program stored in the ROM 631 and settings by an operation portion 601. For example, the operation portion 601 is installed on the copying machine body 130 such that a user can perform a setting operation.

The printer controller 635 controls the copying machine body 130. The storing apparatus controller 636 controls the sheet storing apparatus 300. Although a configuration where the sheet storing apparatus 300 is provided with the storing apparatus controller 636 is described in the present exemplary embodiment, the present invention is not limited to this configuration. That is, a configuration where the copying machine body 130 is provided with the storing apparatus controller 636 together with the CPU circuit portion 630 and the sheet storing apparatus 300 is controlled by the side of the copying machine body 130 is also possible.

The RAM 650 is used as an area for temporarily retaining a control data and as a work area for calculation required by the control. The external interface 637, which is an interface connected with a computer (PC) 620, converts a print data to an image and outputs the image to the image signal controller 634. The image output from the image signal controller 634 to the printer controller 635 is input to an exposure controller (not shown).

Figure 4:
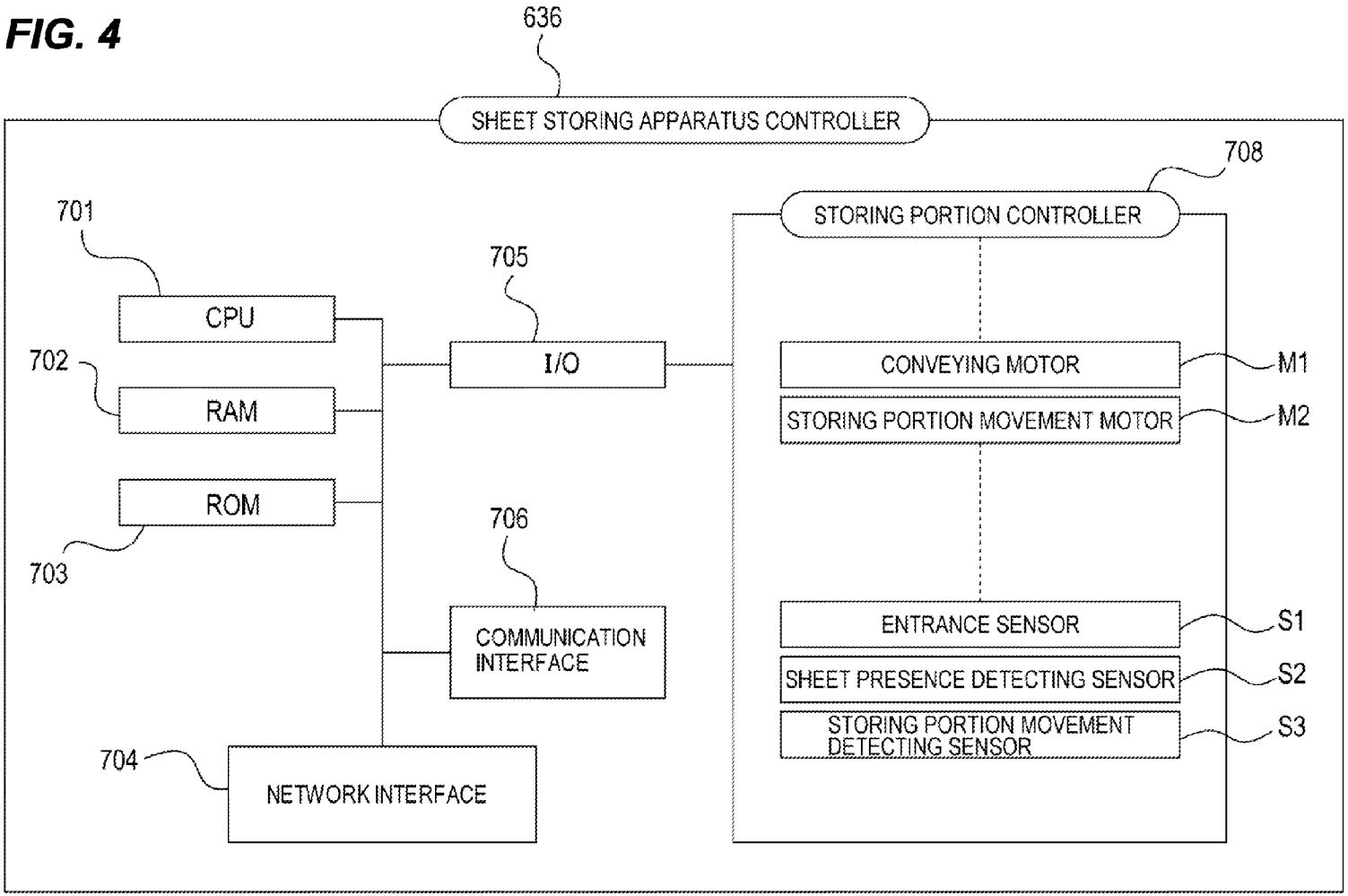
FIG. 4 is a block diagram illustrating a control system for controlling the sheet storing apparatus in the first exemplary embodiment.

Next, a control system for controlling the sheet storing apparatus 300 will be described with reference to FIG. 4. FIG. 4 is a block diagram illustrating the control system for controlling the sheet storing apparatus 300 in the present exemplary embodiment.

The storing apparatus controller 636 has a CPU 701, a RAM 702, a ROM 703, a network interface 704, a communication interface 706, a storing portion controller 708 and an I/O 705 associated with the storing portion controller 708.

The storing portion controller 708 has a conveying motor M1, a storing portion movement motor M2, an entrance sensor S1, a sheet presence detecting sensor S2 and a storing portion movement detecting sensor S3. The storing apparatus controller 636 controls the motors M1 and M2 based on results of sensing by the sensors S1 to S3. Moreover, the storing apparatus controller 636 performs communication between the CPU 701 and the CPU circuit portion 630 of the copying machine body 130 to transmit and receive data.

Figure 3A:
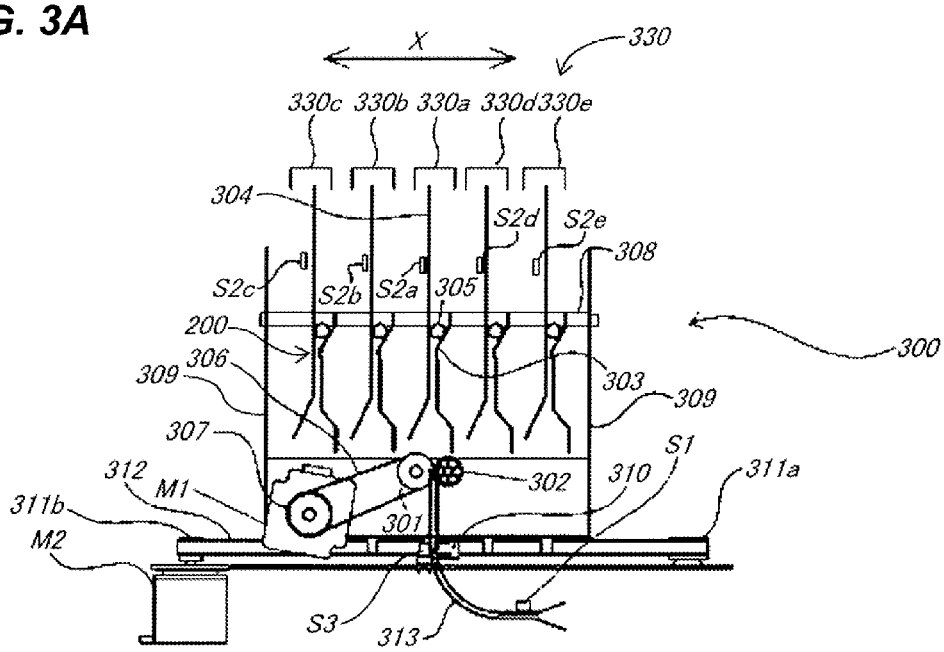
FIGS. 3A and 3B respectively are a cross-sectional view and a perspective view of a sheet storing apparatus in a first exemplary embodiment of the present invention.
Figure 3B:
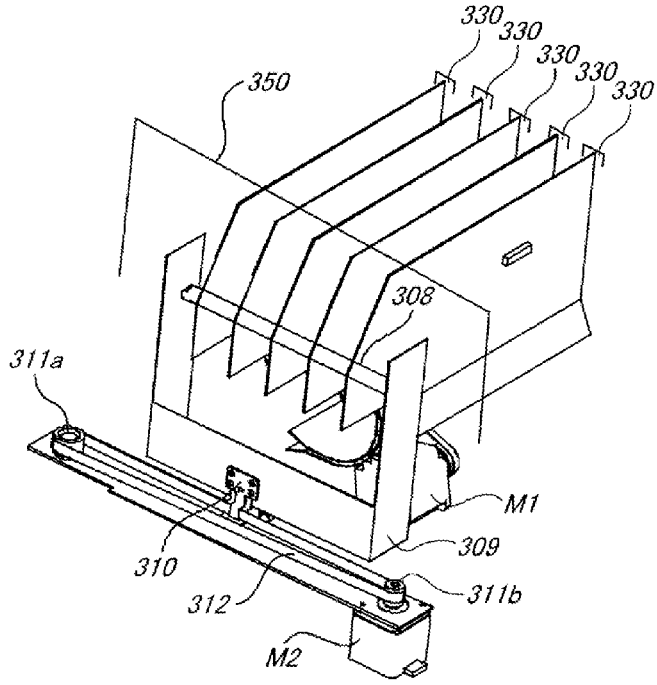
Figure 5:
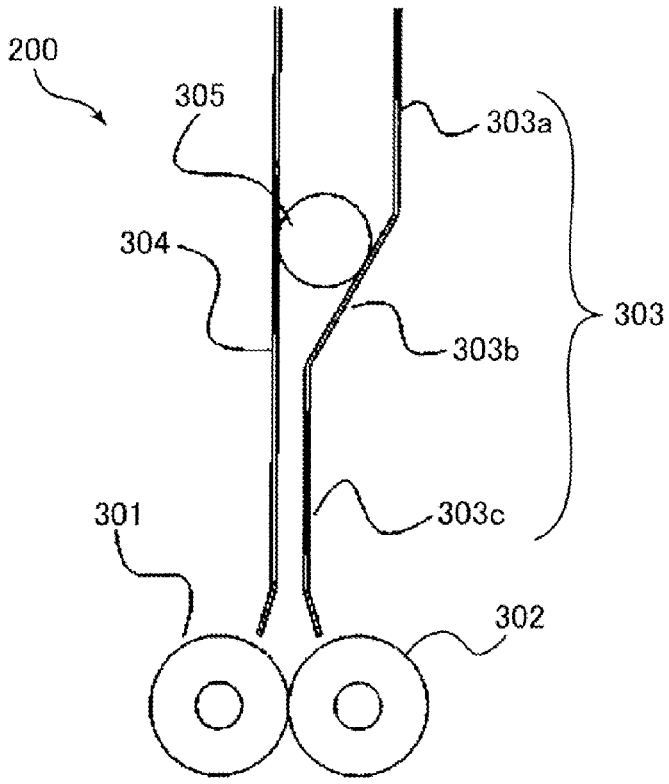
FIG. 5 is a cross-sectional view illustrating a sheet storing portion in the first exemplary embodiment of the present invention.
Figure 6A:
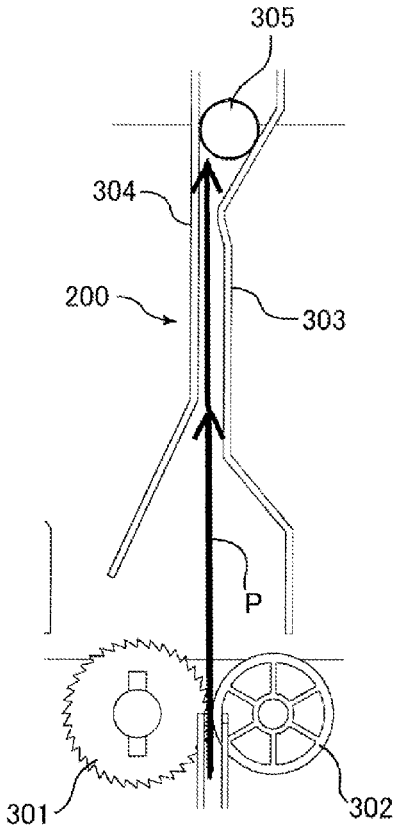
FIGS. 6A and 6B are explanatory diagrams of a sheet storing operation in the first exemplary embodiment.
Figure 6B:
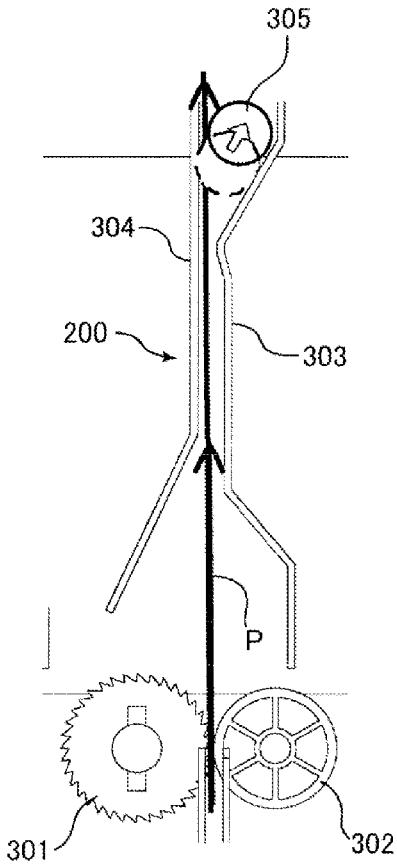
Figure 7A:
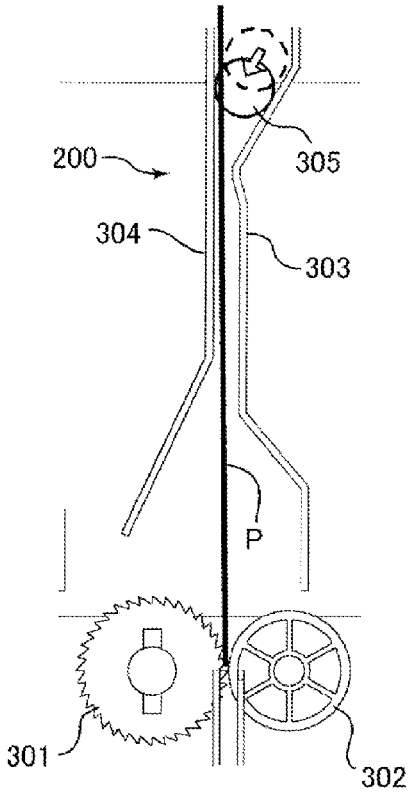
FIGS. 7A and 7B are explanatory diagrams of the sheet storing operation in the first exemplary embodiment.
Figure 7B:
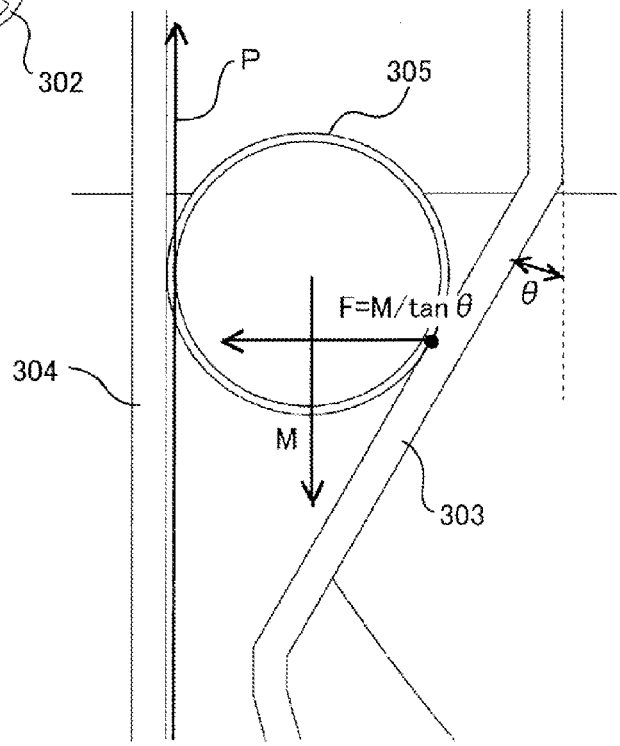

[Sheet storing apparatus] Next, the sheet storing apparatus 300 will be described with reference to FIGS. 1 and 3 to 8. FIGS. 3A, 3B and 4 respectively are a cross-sectional view, a perspective view and a block diagram of the sheet storing apparatus 300 according to the present exemplary embodiment. FIG. 5 is a cross-sectional view of a sheet storing portion serving as a basis for the present exemplary embodiment. FIGS. 6A and 6B are explanatory diagrams of an operation of the sheet storing apparatus 300 according to the present exemplary embodiment. FIGS. 7A and 7B are explanatory diagrams of an operation of the sheet storing apparatus 300. FIGS. 8A to 8F are explanatory diagrams of an operation of the sheet storing apparatus 300.

The sheet storing apparatus 300 is provided on the top of the copying machine body 130. The sheet storing apparatus 300 has a plurality of sheet storing portions 330*a* to 330*e* which receives a sheet sequentially conveyed from the copying machine body 130, i.e. receives a sheet from below and stores the received sheet in a vertical state. The sheet storing portions 330*a* to 330*e* are supported together by a storing portion connecting shaft (support shaft) 308 to be in parallel with each other. Furthermore, the sheet storing portions 330*a* to 330*e* respectively have sheet holding portions 200. Each sheet holding portion 200 receives a sheet from the copying machine body 130 and holds the received sheet with permitting sheet movement in a sheet conveying direction while restricting sheet movement in a direction opposite to the sheet conveying direction.

A sheet P is discharged by the pair of discharge rollers 110 of the copying machine body 130 and then fed to the sheet storing portions 330*a* to 330*e* through a bent shaped conveying guide 313 provided below, as shown in FIGS. 1 and 3A. The entrance sensor S1 is provided at an inlet portion of the conveying guide 313. The convey timing of the sheet P from the copying machine body 130 is monitored based on sensing by the entrance sensor S1.

The conveying motor M1 and a conveying roller driving gear 307 for transmitting driving force by the conveying motor M1 are installed downstream of the conveying guide 313. Rotation of the conveying roller driving gear 307 is transmitted to a conveying roller 301 through a conveying roller driving belt 306. The conveying roller 301 and a convey driven roller 302 are arranged to face each other. The conveying roller 301 and the convey driven roller 302 thus provided to face each other constitute a pair of conveying rollers (301, 302) adapted to feed (convey) the sheet into the sheet holding portion 200. The sheet P discharged from the copying machine body 130 is conveyed by the conveying roller 301 and the convey driven roller 302 into the sheet storing portions 330*a*, 330*b*, 330*c*, 330*d* and 330*e* (the sheet storing portions 330*a*, 330*b*, 330*c*, 330*d* and 330*e* as a whole may be hereinafter referred to as a "sheet storing portion 330").

As shown in FIG. 1, the sheet storing portions 330*a* to 330*e* are arranged along a width direction of the color copying machine 100 (i.e. left-right direction in FIG. 1) to be in parallel with each other. As shown in FIGS. 3A and 3B, the sheet storing portions 330*a* to 330*e* are linked one after another through the storing portion connecting shaft 308 extending in the width direction and a holding board 309 having a substantially U-shape as a whole.

The sheet storing apparatus 300 has a pair of conveying rollers (301, 302) having a nip portion (sheet conveying portion). The nip portion conveys the sheet discharged from the copying machine body 130 to the sheet storing portions 330*a* to 330*e*. The sheet storing portions 330*a* to 330*e* respectively have the sheet holding portions 200. Each sheet holding portion 200 receives a sheet conveyed from the nip portion and holds the received sheet with permitting sheet movement in the sheet conveying direction while restricting sheet movement in a direction opposite to the sheet conveying direction. The sheets conveyed from the nip portion to the sheet holding portion 200 of the sheet storing portion 330 include a preceding sheet P1 and a subsequent sheet P2 conveyed subsequently to the preceding sheet P1. The above-mentioned conveying roller 301 displaces a rear end (i.e. an upstream end in the sheet conveying direction) of the preceding sheet P1 in one direction (leftward direction in FIG. 8) to deviate from a forward end (i.e. a downstream end in the sheet conveying direction) of the subsequent sheet P2. A large number of elastic projection portions 301*a* are formed on a periphery of the conveying roller 301. In other words, the periphery of the conveying roller 301 which is one of the pair of conveying rollers (301, 302) has a plurality of elastic projection portions 301*a* and thereby constitutes a sheet displacing portion.

A movement connecting member 310 is secured to a central portion of a bottom link portion of the holding board 309. The storing portion movement motor M2 having a pulse motor drives the holding board 309 and thus the sheet storing portions 330*a* to 330*e* through the movement connecting member 310, movement pulleys 311*a*, 311*b* and a movement belt 312. That is, the sheet storing portions 330*a* to 330*e* are adapted to be movable in an integrated manner in an X-direction (left-right direction) in FIG. 3A. The movement belt 312 is an endless timing belt. The movement pulleys 311*a* and 311*b* each has a periphery having tooth portions whose pitch meshes that of tooth portions of the movement belt (timing belt) 312.

The storing portion movement motor M2, the movement pulleys 311*a*, 311*b* and the movement belt 312 constitute a driving portion. The driving portion moves the whole of the sheet storing portions with respect to the sheet conveying portion such that a sheet storing portion selected from among the sheet storing portions 330*a* to 330*e* can receive a sheet discharged from the copying machine body 130. The nip portion of the pair of conveying rollers (301, 302) is equivalent to the sheet conveying portion.

The pair of conveying rollers (301, 302), the conveying motor M1, the storing portion movement motor M2 and the movement pulleys 311*a* and 311*b* are secured to a body of the sheet storing apparatus 300. By contrast, the sheet storing portions 330*a* to 330*e* are so supported as to be movable in the left-right direction. Therefore, a relative position of the sheet storing portions 330*a* to 330*e* with respect to the pair of conveying rollers (301, 302) can be changed by the movement in the left-right direction. This enables sorting and storing the sheets P into the sheet storing portions 330*a* to 330*e*.

Moreover, the storing portion movement detecting sensor S3 is secured to the body of the sheet storing apparatus 300. When the holding board 309 is positioned at its home position in the left-right direction shown in FIG. 3A, the storing portion movement detecting sensor S3 is located at a position corresponding to a bottom central portion of the holding board 309. Therefore, the storing portion movement detecting sensor S3 can detect a position of the movement connecting member 310 of the holding board 309. The storing portion movement detecting sensor S3 determines the convey position with respect to the sheet storing portions 330*a* to 330*e* based on a home position of the sheet storing portions 330*a* to 330*e* in the X-direction (left-right direction) in FIG. 3A and the number of driving pulses of the storing portion movement motor M2 from the home position.

Furthermore, the sheet storing portions 330*a* to 330*e* are provided with the sheet presence detecting sensors S2 (S2*a* to S2*e*), respectively. The respective sheet presence detecting sensors S2*a* to S2*e* detect whether or not a sheet P is stored in the corresponding sheet storing portions 330*a* to 330*e*. Based on the detection, the CPU 701 of the storing apparatus controller 636 (refer to FIG. 4) determines the position such that the next sheet P discharged from the copying machine body 130 is conveyed into a sheet storing portion in which no sheet is stored.

Next, the sheet holding portion 200 of the sheet storing portion 330 will be described with reference to FIGS. 3A and 5. As shown in FIG. 3A, each of the sheet storing portions 330*a* to 330*e* is provided with the sheet holding portion 200. The sheet holding portion 200 has a storing guide board 304 and a conveying guide 303 as shown in FIG. 5.

When the sheet holding portion 200 has already received and held some sheets, the sheet holding portion 200 can further receive subsequent sheets in order until one job is completed. The sheet holding portion 200 has the storing guide board 304 extending in a substantially vertical direction and the conveying guide 303 extending in a substantially vertical direction and facing the storing guide board 304. The conveying guide 303 has a facing wall portion 303*a* and an inclined surface portion 303*b* that face the storing guide board 304 with certain distance from the storing guide board 304. The inclined surface portion 303*b* is adapted to extend downward from a lower end of the facing wall portion 303*a* and to be inclined toward the storing guide board 304 at a certain degree. In the present exemplary embodiment, the inclined surface portion 303*b* is formed by a planar surface. The conveying guide 303 further has a conveying guide portion 303*c* extending downward from a lower end of the inclined surface portion 303*b* and parallel to the storing guide board 304 to guide a sheet.

A holding member 305 is provided to be movable surrounded by inner surfaces of the storing guide board 304, the facing wall portion 303*a* and the inclined surface portion 303*b*. The holding member 305 can move freely in the upward direction along which an inter-guide interval becomes larger while cannot move freely in the downward direction along which the inter-guide interval becomes smaller. In addition, the conveying guide 303 has a locking portion for preventing the holding member 305 from dropping off even when the holding member 305 moves in a front-back direction in FIG. 5. The locking portion is provided so as not to disturb the conveying of the sheet P. It should be noted that a shape of the holding member 305 in the present exemplary embodiment is exemplified by a spherical shape, a cylindrical shape and a spindle shape.

In the present exemplary embodiment, the conveying roller 301 of the pair of conveying rollers (301, 302) shown in FIG. 5 has a cross-structure as shown in FIGS. 6 and 7. That is, the conveying roller 301 has a ratchet tooth shaped periphery and a direction of the tooth is inclined toward downstream in a direction of rotation of the conveying roller 301. The ratchet tooth (a large number of elastic projection portions 301*a*) is formed of elastic material such as rubber. The ratchet tooth may be formed over an entire surface the conveying roller 301 in an axial direction (longitudinal direction) or may be provided only on both ends in the axial direction that comes into contact with the conveyed sheet P.

How a sheet P is held by the sheet holding portion 200 will be described with reference to FIGS. 6A, 6B, 7A and 7B.

A sheet P is conveyed by the pair of conveying rollers (301, 302) into the sheet holding portion 200 (FIG. 6A), and the holding member 305 is moved in an arrow direction by a thickness of the sheet P (FIG. 6B). When a read end of the sheet P passes through the nip portion of the pair of conveying rollers (301, 302), the sheet P is held by the storing guide board 304 and the holding member 305 (FIG. 7A).

The holding member 305 can freely move in the arrow direction shown in FIG. 6B, and inserting the sheet P between the storing guide board 304 and the holding member 305 in this manner requires just weak force enough to move the holding member 305 by the thickness of the sheet P. When the rear end of the inserted sheet P passes through the pair of conveying rollers (301, 302), gravity acting on the holding member 305 applies abutment force F ($F=M/\tan\theta$) toward the inner surface of storing guide board 304 through the inclined surface portion 303*b* (refer also to FIG. 5) of the conveying guide 303 (FIG. 7B). Due to the abutment force F acting as a wedge effect, the sheet P is held in the sheet holding portion 200 without dropping.

Thereafter, a subsequent sheet P is conveyed between the storing guide board 304 and the conveying guide 303 as in the case of the preceding sheet P held at the inner surface of the storing guide board 304, and is inserted to a nip portion of the holding member 305 and the preceding sheet P. As a result, the subsequent sheet P as well as the preceding sheet P is held in the storing guide board 304 due to the abutment force F.

In this manner, the sheet is allowed to pass through in the sheet conveying direction but sheet movement in a direction opposite to the sheet conveying direction is restricted. This operation is repeatedly performed with respect to the sheets P conveyed, and thereby the plurality of sheets P can be stored in the sheet storing portions 330*a* to 330*e*. When the sheets P held between the storing guide board 304 and the holding member 305 are pulled in the upward direction or the front-back direction of the sheet storing apparatus 300, the wedge effect does not work. Therefore, the sheets (or sheet bundle) can be easily removed from the sheet holding portion 200 namely the sheet storing portion 330 with one hand.

Next, displacing the sheet rear end for successive sheets holding in the present embodiment will be described with reference to FIGS. 8A to 8F.

Figure 8A:
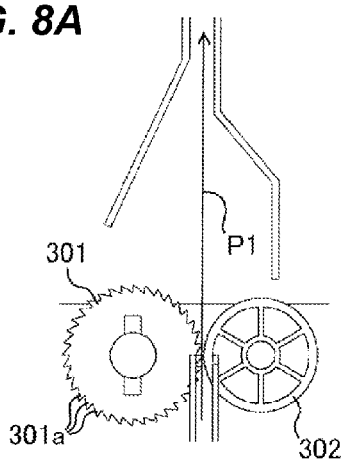
FIGS. 8A to 8F are explanatory diagrams of the sheet storing operation in the first exemplary embodiment.
Figure 8B:
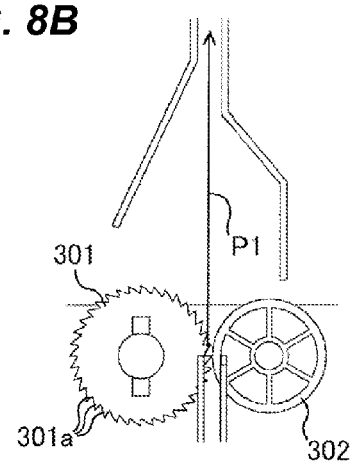
Figure 8C:
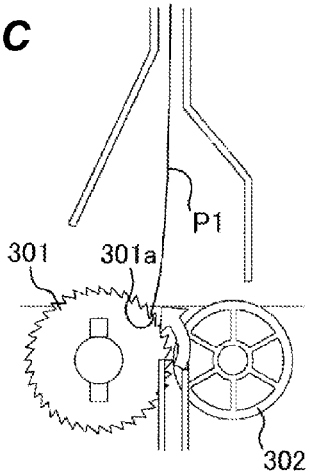
Figure 8D:
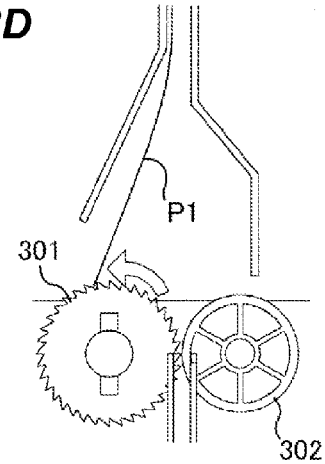
Figure 8E:
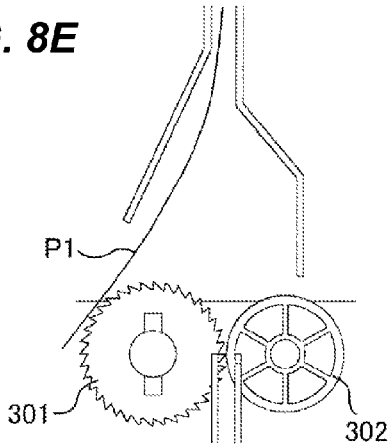

As shown in FIG. 8A, a first sheet P1 (preceding sheet) is conveyed by the pair of conveying rollers (301, 302) into the sheet storing portion 330. Then, as shown in FIG. 8B, a rear end of the sheet P1 arrives at the nip portion of the pair of conveying rollers (301, 302). Thereafter, the conveying roller 301 continues to rotate in a counter-clockwise direction which is opposite to a rotation direction of the convey driven roller 302. Thus, the rear end of the sheet P1 is guided and displaced by the large number of (a plurality of) elastic projection portions 301*a* of the ratchet tooth shaped conveying roller 301 toward an arrow direction as shown in FIGS. 8C, 8D and 8E. Meanwhile, the convey driven roller 302, which is driven by the conveying roller 301 that rotates in the same direction as the conveying roller 301 rotates and does not function as to bias (guide) the rear end of the sheet P1 in the opposite direction (i.e. a clockwise direction in FIG. 8).

Figure 8F:
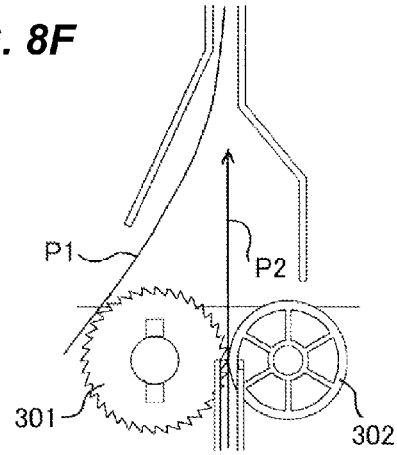

After the rear end of the first sheet P1 is displaced as shown in FIG. 8E, a forward end of a second sheet P2 (subsequent sheet) is inserted to the nip portion of the pair of conveying rollers (301, 302) (FIG. 8F). In other words, the forward end of the subsequent sheet P2 is inserted after the rear end of the preceding sheet P1 is guided to the opposite side of the holding member 305 (i.e. leftward in FIG. 6). In this manner, the displacement of the sheet rear end can be achieved. The subsequent sheet P2 is inserted and held by the holding member 305, as in the case of the preceding sheet P1.

As described above, the rear end of the preceding sheet P1 and the forward end of the subsequent sheet P2 do not interfere with each other. Moreover, the subsequent sheet P2 is prevented from being inserted to the storing guide board 304 side of the preceding sheet P1 (i.e. left side of P1 in FIG. 8F), which can prevent sheet order reversal within the job. Furthermore, a third sheet P3, a fourth sheet P4 . . . can be successively and appropriately stored in a similar manner. Thus, the sheets can be successively stored in a selected one of the sheet storing portions 330*a* to 330*e* regularly without causing inconvenience such as sheet order reversal within the job.

Figure 9:
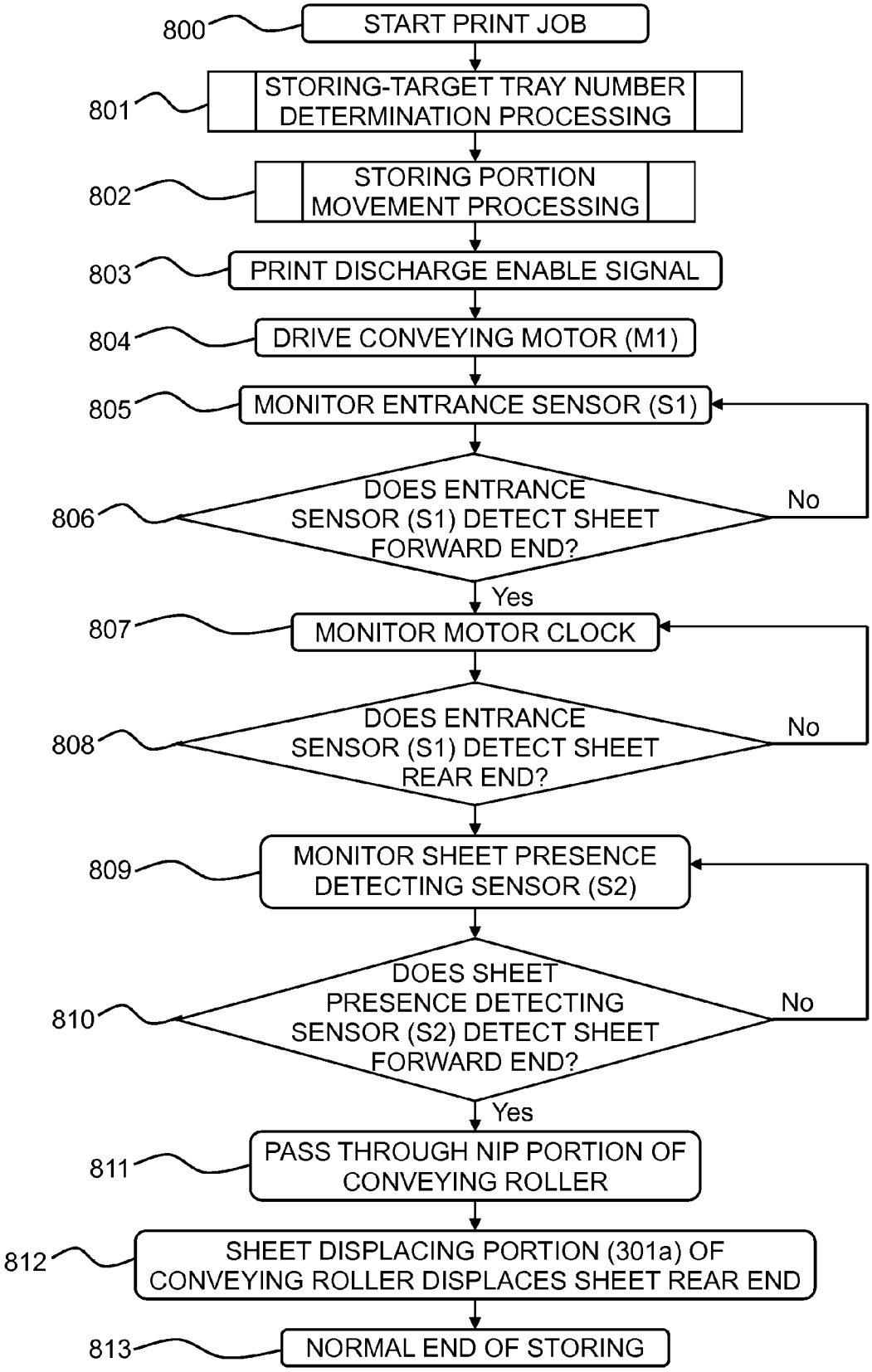
FIG. 9 is a flow chart for describing an action of the first exemplary embodiment.
Figure 10:
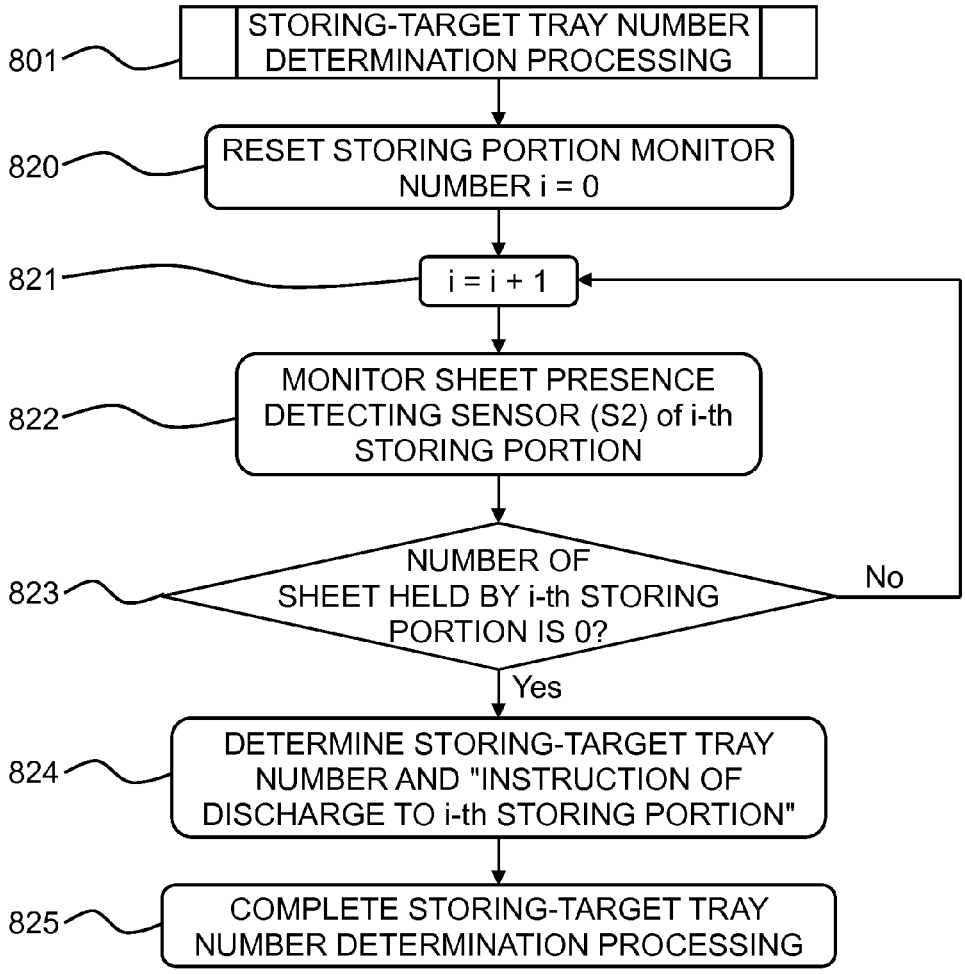
FIG. 10 is a flow chart for describing the action of the first exemplary embodiment.
Figure 11:
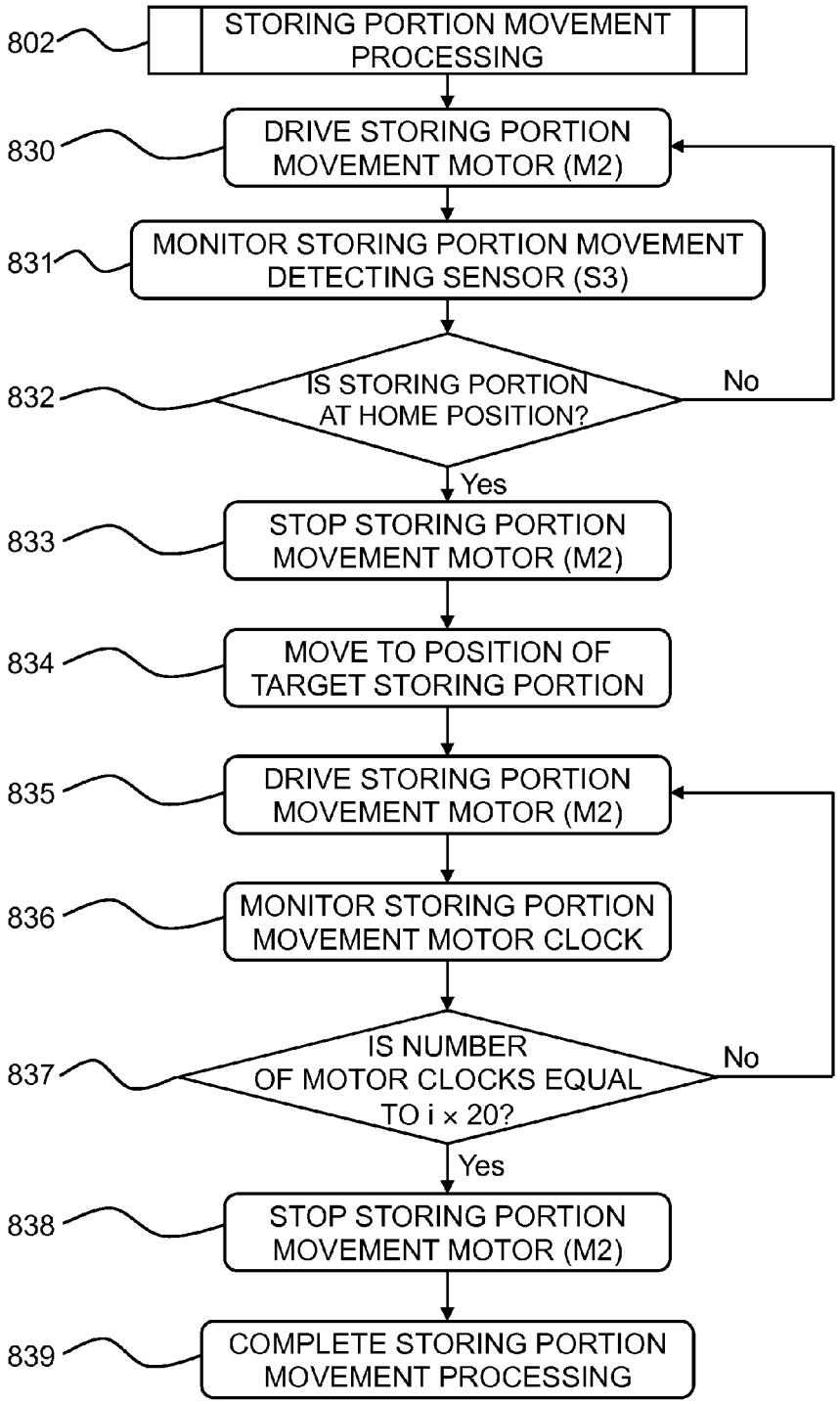
FIG. 11 is a flow chart for describing the action of the first exemplary embodiment.

[Description of sheet storing operation flow] Next, an operation flow for storing the sheet P discharged from the copying machine body 130 in the sheet storing apparatus 300 will be described with reference to flow charts shown in FIGS. 9 to 11.

When a print job is submitted to the color copying machine 100 (Step 800), the flow proceeds to storing-target tray number determination processing (Step 801). As shown in FIG. 10, a storing portion monitor number i is first reset to be 0 (820). Next, 1 is added to the storing portion monitor number i (821).

Subsequently, the sheet presence detecting sensor S2 of the i-th (=1st) sheet storing portion 330 is monitored, and whether or not there is any sheet held by the i-th (=1st) sheet storing portion 330 is determined (823). If there is any sheet held by the i-th (=1st) sheet storing portion 330, the flow returns back to Step 821, 1 is added to the storing portion monitor number i and whether or not there is any sheet held by the i-th (=2nd) sheet storing portion 330 is determined.

In this manner, if there is any sheet held by the sheet storing portion 330, the same processing is repeated until monitoring of the fifth sheet storing portion 330 is completed. If there is any sheet held by the fifth sheet storing portion 330, namely, if every sheet storing portion 330 already has a sheet, the CPU 701 outputs a "STACK FULL" signal.

If there is no sheet held by the i-th sheet storing portion 330, the i-th sheet storing portion 330 is determined as a convey destination. A command of conveying to the i-th sheet storing portion 330 is output, and the storing-target tray number determination processing is completed (824, 825).

After that, the flow proceeds to storing portion movement processing (802). As shown in FIG. 11, the storing portion movement motor M2 is driven, the storing portion movement detecting sensor S3 is moved to the detecting position, and the sheet storing portions 330*a* to 330*e* are temporarily moved to the home position (830 to 832).

After that, the number of clocks of the storing portion movement motor (M2) is counted until the i-th sheet storing portion 330 determined by the storing-target tray number determination processing (801) moves from the home position to a position corresponding to the nip portion of the pair of conveying rollers (301, 302). Then, the sheet storing portions 330*a* to 330*e* are stopped at a predetermined position (834 to 839).

After the storing portion movement processing (802) is completed, a print discharge enable signal is output (803) to drive the conveying motor M1 of the sheet storing apparatus 300 (804). In preparation for sheet conveying from the copying machine body 130, the entrance sensor S1 monitors a sheet arrival.

A jam signal is output in the following cases (805 to 810).

(1) The sheet forward end does not reach the entrance sensor S1 at a predetermined timing.

(2) The sheet rear end is not detected even when a predetermined number of motor clocks has passed after the sheet forward end has passed through the entrance sensor S1.

(3) The sheet presence detecting sensor S2 of the sheet storing portions 330*a* to 330*e* does not detect the sheet P even after a predetermined number of motor clocks has passed.

If the sheet presence detecting sensor S2 outputs a detection signal within the predetermined number of motor clocks, it is determined that the sheet is correctly held by the sheet holding portion 200 of the sheet storing portion 330 and the print job is normally completed (811 to 813).

According to the present exemplary embodiment as described above, the sheet storing portions 330*a* to 330*e* provided in a vertical state are used instead of the conventional stack tray provided in a substantially horizontal or a slightly inclined state. It is therefore possible to provide a space-saving and compact sheet storing apparatus 300. Moreover, the sheet storing portions 330*a* to 330*e* are adapted to store the sheet P in the vertical state, which can prevent an installation space (a length in the width direction) of the sheet storing apparatus 300 from increasing even when a large size sheet is stored.

Moreover, the sheet storing apparatus 300 has the nip portion (sheet conveying portion) of the pair of conveying rollers (301, 302), the sheet holding portions 200 of the respective sheet storing portions 330*a* to 330*e*, and the conveying roller 301 having the elastic projection portion 301*a* as the sheet displacing portion. As a result, the conveying roller 301 displaces the rear end of the preceding sheet P1 conveyed into the sheet holding portion 200 toward a direction (one direction) opposite to the sheet conveying direction so as to deviate from the convey route of the forward end of the subsequent sheet P2. Therefore, inconveniences can be certainly avoided, such as that the subsequent sheet P2 interferes with the preceding sheet P1 or the subsequent sheet P2 is buried in the preceding sheets P1 and thus the sheets are not stored in the correct order.

It should be noted that the configuration for avoiding the above-mentioned inconveniences such as that the subsequent sheet P2 interferes with the preceding sheet P1 or the subsequent sheet P2 is buried in the preceding sheets P1 and thus the sheets are not stored in the correct order is not limited to the conveying roller 301 provided with the elastic projection portions 301*a*. For example, a guide member 350 adapted to displace the rear end of the preceding sheet P1, which is conveyed from the nip portion of the pair of conveying rollers (301, 302) to the sheet holding portion 200, toward the leftward direction so as to deviate from the convey route of the forward end of the subsequent sheet P2 (refer to FIG. 14) can also provide the same effects. According to this configuration, the conveying guide 303 has a facing wall portion 303*a* and an inclined surface portion 303*b* that face a vertical wall portion 304*a* of the storing guide board 304 with certain distance from the vertical wall portion 304*a*. The inclined surface portion 303*b* is adapted to extend downward from a lower end of the facing wall portion 303*a* and to be inclined toward the vertical wall portion 304*a* at a certain degree. The conveying guide 303 further has a conveying guide portion 303*c* extending downward from a lower end of the inclined surface portion 303*b* and parallel to the vertical wall portion 304*a* to guide a sheet.

The storing guide board 304 in this configuration has the above-mentioned vertical wall portion 304*a* and an inclined surface portion 304*b*. The inclined surface portion 304*b* is adapted to extend downward from a lower end of the vertical wall portion 304*a* and to be inclined away from the conveying guide portion 303*c* at a predetermined degree. The storing guide board 304 further has a conveying guide portion 304*c* and an inclined surface portion 304*d*. The conveying guide portion 304*c* is adapted to extend downward from a lower end of the inclined surface portion 304*b* and parallel to the conveying guide portion 303*c* to guide a sheet. The inclined surface portion 304*d* is adapted to extend downward from a lower end of the conveying guide portion 304*c* and to be inclined away from the conveying guide portion 303*c* at a predetermined degree.

Figure 12A:
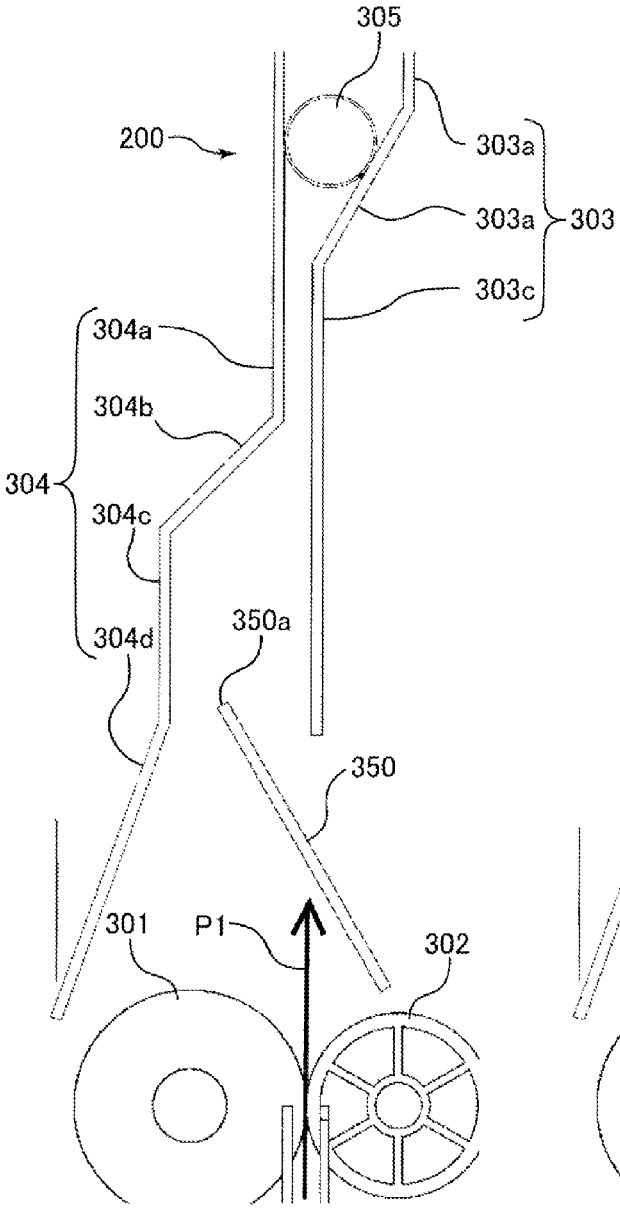
FIGS. 12A and 12B are explanatory diagrams of another sheet storing operation.

According to the first exemplary embodiment as shown in FIG. 5, the conveying guide portion 303*c* is located a little to the right in the drawing, and thereby the sheet convey route between the conveying guide portion 303*c* and the storing guide board 304 is substantially on an upward extension line of the nip portion of the pair of conveying rollers (301, 302). In contrast to this, according to the exemplary embodiment as shown in FIG. 12A, the conveying guide portion 303*c* is located a little to the left as compared with the case shown in FIG. 5 such that the conveying guide portion 303*c* is substantially on the upward extension line of the nip portion. That is to say, the sheet convey route between the conveying guide portion 303*c* and the vertical wall portion 304*a* is adapted to be substantially on the upward extension line of the nip portion.

The guide member 350 is provided between the lower end of the conveying guide portion 303*c* and the nip portion of the pair of conveying rollers (301, 302). A lower end of the guide member 350 is located near an upper central part of the convey driven roller 302, and the guide member 350 obliquely extends from the lower end toward the conveying guide portion 304*c*. Thus, the forward end of the sheet that has passed through the nip portion of the pair of conveying rollers (301, 302) is guided by the guide member 350 toward the side of the conveying guide portion 304*c*. The guide member 350 is secured to the body of the sheet storing apparatus 300 such that the above-described guiding condition can be achieved.

Figure 12B:
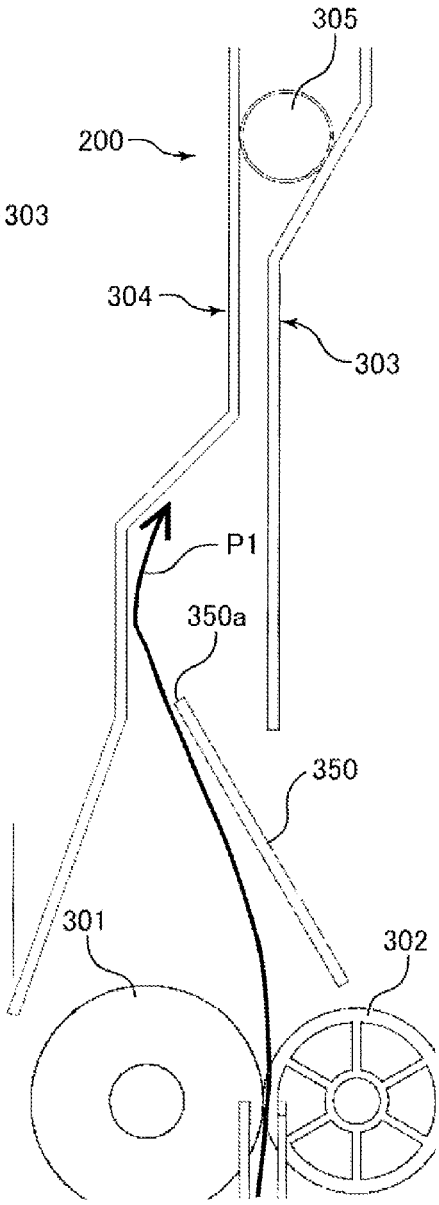
Figure 13A:
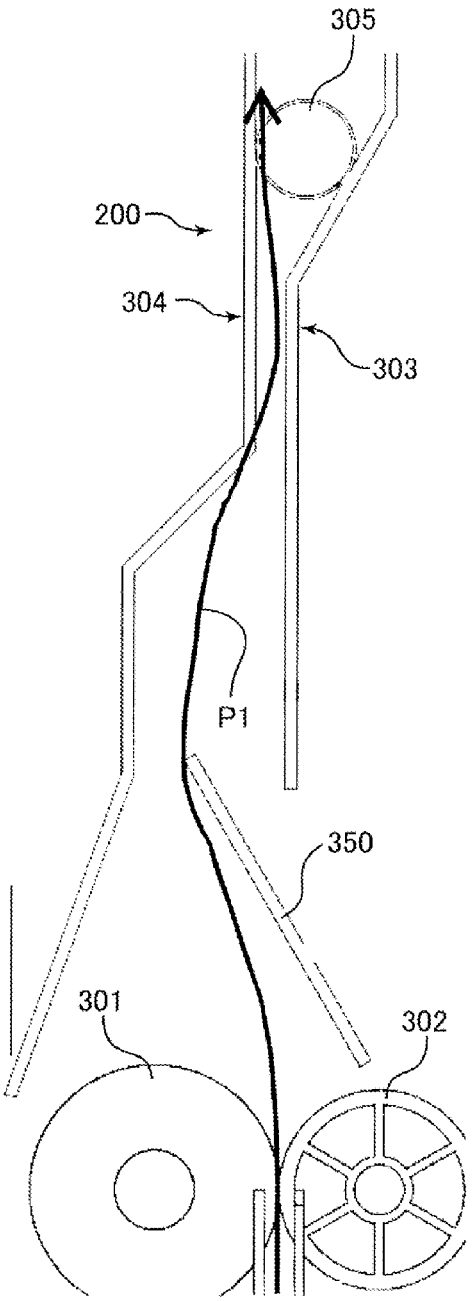
FIGS. 13A and 13B are explanatory diagrams of the other sheet storing operation.
Figure 13B:
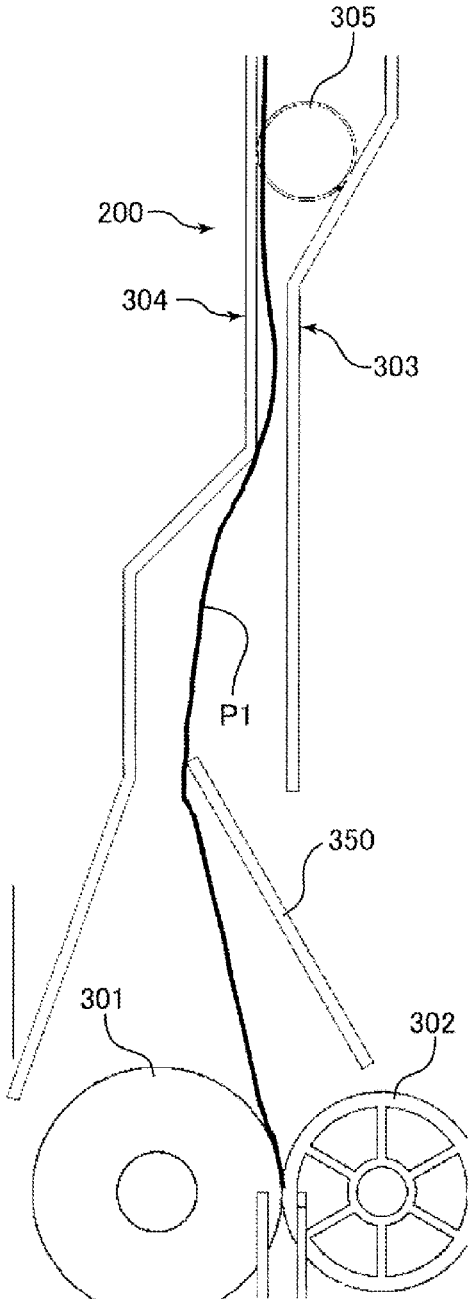

By the above-described configuration, the forward end of the preceding sheet P1 conveyed from the nip portion of the pair of conveying rollers (301, 302) is guided along an inner surface of the guide member 350 toward the inner surface of the storing guide board 304. Therefore, as shown in FIG. 12B, the forward end of the sheet P1 guided from the guide member 350 to the conveying guide portion 304*c* and the inclined surface portion 304*b* passes through a space between the vertical wall portion 304*a* and the conveying guide portion 303*c*. At the same time, as shown in FIGS. 13A and 13B, the sheet P1 is inserted between the holding member 305 and the vertical wall portion 304*a* and nipped by the holding member 305 and the vertical wall portion 304*a*. Here, the rear end side portion of the sheet P1 contacts slidingly with an upper end portion 350*a* of the guide member 350. That is, the forward end portion of the sheet P1 is held by the holding member 305 while the rear end portion thereof is biased (guided) by the upper end portion 350*a* toward the side of the inclined surface portion 304*d*. Therefore, when the rear end of the sheet P1 passes through the nip portion of the air of conveying rollers (301, 302), the biasing force and rotation of the conveying roller 301 in the counter-clockwise direction act together to move the rear end of the sheet P1 toward the leftward (one direction) in the drawing so as to deviate from the convey route of the forward end of the subsequent sheet P2 (refer to FIGS. 14A and 14B).

That is to say, in the above-described configuration, the first sheet P1 in the job is conveyed from the nip portion of the pair of conveying rollers (301, 302) (FIG. 12A). Then, the sheet forward end is guided toward the side of the storing guide board 304 with contacting slidingly with the upper end portion 350*a* of the guide member 350 (see the status illustrated in FIG. 12B).

After that, the forward end of the sheet P1 is guided in a space between the storing guide board 304 and the conveying guide 303 and inserted into between the holding member 305 and the vertical wall portion 304*a* (FIG. 13A). Thus, as in the case of the first exemplary embodiment, the sheet P1 is held by the biasing force F due to gravity acting on the holding member 305 (refer to FIG. 7B).

Figure 14A:
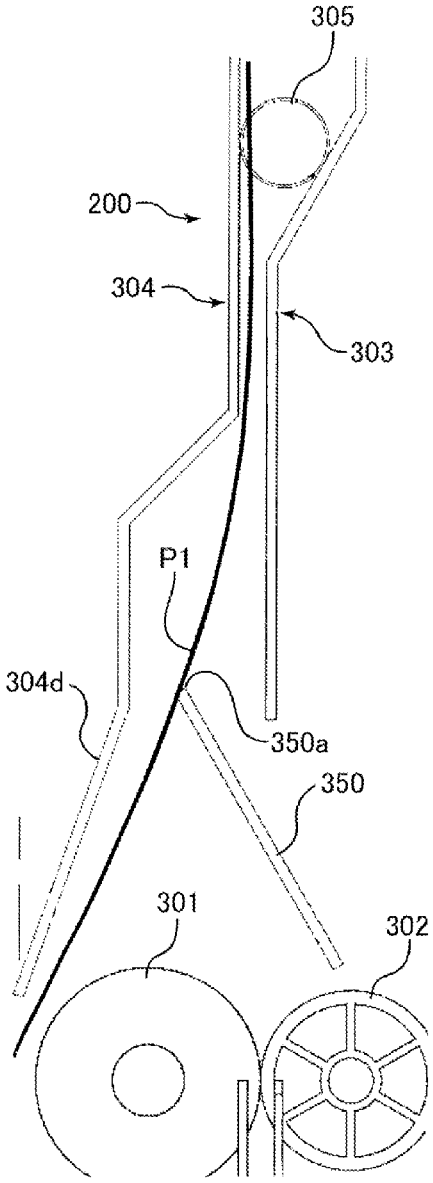
FIGS. 14A and 14B are explanatory diagrams of the other sheet storing operation.

When the rear end of the sheet P1 passes through the conveying roller 301, namely, when the conveying of the sheet P1 to the holding member 305 is completed, as shown in FIG. 13B, the sheet P1 is strongly biased by the guide member 350 toward the left side in FIG. 13B (i.e. toward the side of the conveying roller 301). As a result, abutment force toward the conveying roller 301 is increased, and the rear end of the sheet P1 is driven by the rotation of the conveying roller 301 to be displace toward the left side in the drawing (FIG. 14A).

Figure 14B:
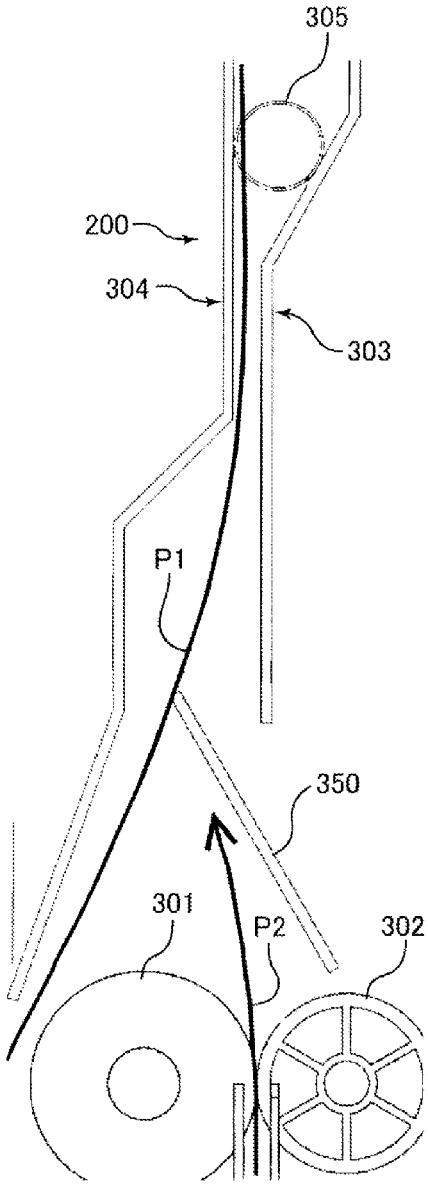

In the above-described condition, the subsequent sheet P2 is conveyed from the nip portion of the pair of conveying rollers (301, 302). In this case, as shown in FIG. 14B, the sheet P2 always passes on the conveying guide 303 side of the preceding sheet P1 (i.e. on the right hand side in FIG. 14B). As a result, interference of the rear end of the preceding sheet P1 and the forward end of the subsequent sheet P2 can be securely avoided, and the sheets can be stored always in the correct order P1, P2, P3 . . . in each of the sheet storing portion 330*a* to 330*e*.

It should be noted that the configuration of the guide member 350 is not limited to that illustrated in FIGS. 12 to 14 where the guide member 350 is fixedly arranged in the inclined state. That is, the guide member 350 may be adapted to retract, when the sheet forward end of the sheet is conveyed from the nip portion of the pair of conveying rollers (301, 302), to a position where interference with the sheet can be avoided and then move so as to abut with the rear end side portion of the conveyed sheet. Moreover, also in the present exemplary embodiment, a ratchet tooth having a large number of elastic projection portions formed of elastic material such as rubber may be provided on the periphery of the conveying roller 301, as in the case of the first exemplary embodiment described above.

Second Exemplary Embodiment

Next, a sheet storing apparatus 300 and a color copying machine 100 according to a second exemplary embodiment of the present invention will be described with reference to FIGS. 15 to 17. In the present exemplary embodiment, the same reference numerals are given to the same components as those described in the first exemplary embodiment and an overlapping description will be omitted as appropriate. Moreover, the I/Os of such as motors and sensors are the same as in the case of the first exemplary embodiment, and the block diagram is omitted. Furthermore, the sheet storing operation flow also is the same as in the case of the first exemplary embodiment, and the flow chart is omitted.

Figure 15A:
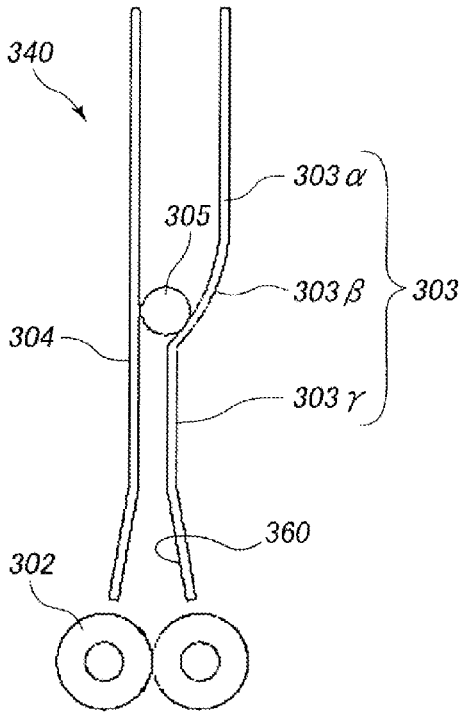
FIGS. 15A and 15B are cross-sectional views illustrating a sheet holding portion of a sheet storing portion according to a second exemplary embodiment.
Figure 15B:
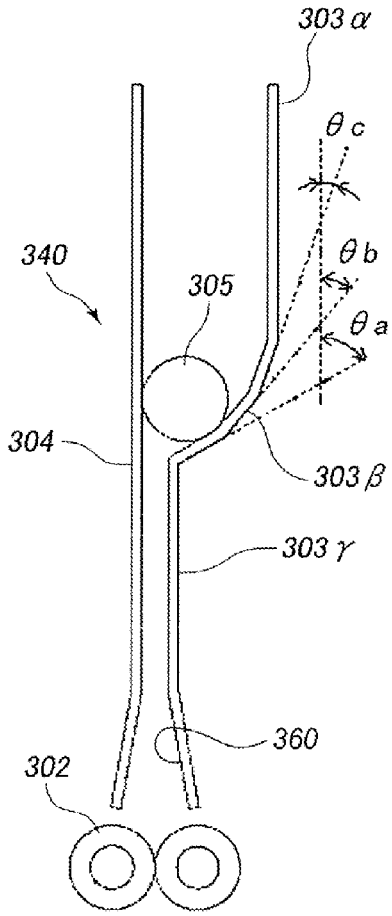

Each of sheet storing portions 330*a* to 330*e* constituting five sheet storing portions 330 (330*a* to 330*e*) in the present exemplary embodiment will be described in detail with reference to FIGS. 15A and 15B. FIG. 15A is a cross-sectional view illustrating an example of a sheet holding portion 340 of the sheet storing portion 330 according to the second exemplary embodiment. FIG. 15B is a cross-sectional view illustrating another example of the sheet holding portion 340 of the sheet storing portion 330 according to the second exemplary embodiment. It should be noted that the sheet storing portions 330*a* to 330*e* each has the same configuration and they may be referred to as a sheet storing portion 330 in the following description.

The sheet storing portion 330 has a sheet holding portion 340 and a reception portion 360. The sheet holding portion 340 is adapted to allow the sheet P to pass through in the sheet conveying direction and to prevent the sheet P from moving in a direction opposite to the sheet conveying direction. The reception portion 360 is adapted to receive, from below, the sheet P that is successively conveyed by the conveying roller 301.

As shown in FIG. 15A, the sheet holding portion 340 has a storing guide 304 as a first guide member that is provided in a vertical state and a conveying guide 303 as a second guide member that is provided to face the storing guide 304. The conveying guide 303 is relatively fixed with respect to the storing guide 304. The sheet holding portion 340 further has a holding member 305 as a rolling member. The holding member 305 is provided in a space between the storing guide 304 and the conveying guide 303 such that the sheet P is nipped by the holding member 305 and the storing guide 304.

The storing guide 304 is adapted to form a side wall of the sheet holding portion 340 and to guide upward the sheet P received from the reception portion 360. The storing guide 304 has a guide surface 304*a* formed substantially vertical, namely, substantially parallel to the vertical direction. The guide surface 304*a* guides one surface of the sheet P.

The conveying guide 303 has a facing wall portion 303α located on an upper side and a conveying guide portion 303γ located on a lower side. The conveying guide portion 303γ and the storing guide 304 are adapted to guide upward the sheet P received from the reception portion 360 together. The conveying guide 303 further has a curved surface portion 303β as an inclined portion that is provided above the conveying guide portion 303γ, namely, between the facing wall portion 303α and the conveying guide portion 303γ. The curved surface portion 303β is formed such that an interval between the curved surface portion 303β and the storing guide 304 increases in the upward direction. More specifically, the curved surface portion 303β is formed such that an inclination angle of the curved surface portion 303β with respect to the guide surface 304*a* of the storing guide 304 decreases with distance from the guide surface 304*a*.

The holding member 305 is formed to have a columnar shape, for example. The holding member 305 is provided to freely roll in a region surrounded by the storing guide 304, the facing wall portion 303α and the curved surface portion 303β of the conveying guide 303. Before the sheet P is conveyed into the sheet holding portion 340, the holding member 305 is in contact with respective inner surfaces of the guide surface 304*a* of the storing guide 304 and the curved surface portion 303β of the conveying guide 303, due to its own weight. That is to say, the holding member 305 is adapted to be able to move freely in the upward direction along which the inter-guide interval becomes larger (i.e. toward the side of the facing wall portion 303α) but restricted from freely moving in the downward direction along which the inter-guide interval becomes smaller (i.e. toward the side of the conveying guide portion 303γ).

In addition, the conveying guide 303 or the storing guide 304 is provided with a locking portion (not shown) for preventing the holding member 305 from dropping off even when the holding member 305 moves in a front-back direction (sheet removal direction) orthogonal to the sheet conveying direction. The locking portion is provided so as not to disturb the conveying of the sheet P.

The holding member 305 moves away from the guide surface 304*a* depending on the number of or a thickness of the sheets P. The holding member 305 and the curved surface portion 303β are in contact with each other at a contact portion. The sheet holding portion 340 is adapted such that an angle of tangent at the above-mentioned contact portion with respect to the guide surface 304*a* decreases as the holding member 305 moves away from the guide surface 304*a*.

In the sheet holding portion 340 according to the present exemplary embodiment, the curved surface portion 303β is formed to have a curved surface in order to achieve the above-mentioned decrease in the inclination angle. However, the holding portion 340 is not limited to that. The curved surface portion 303β may be formed such that the inclination angle becomes smaller in a stepwise fashion with distance from the guide surface 304*a*. For example, as shown in FIG. 15B, the curved surface portion 303β may have an inclined surface whose inclination angle with respect to the guide surface 304*a* is θa, an inclined surface whose inclination angle is θb (θa>θb) and an inclined surface whose inclination angle is θc (θb>θc). These inclined surfaces are connected one after another such that the inclination angle (angle of tangent) becomes smaller in a stepwise fashion with distance from the guide surface 304*a*. By decreasing the inclination angle in a stepwise fashion, it is possible to easily set the inclination angle depending on the thickness of the sheets (i.e. the thickness of the sheet bundle), for example.

In the present exemplary embodiment, a case where the holding member 305 having a columnar shape is used is described as an example. However, the holding member 305 may have a spherical shape, a cylindrical shape or a spindle shape. In addition, a forward end restriction member (not shown) may be provided above the sheet holding portion 340. The forward end restriction member regulates the position of the forward ends of the sheets such as conveyed by the conveying roller 301 or carried by a sheet being conveyed, in order to make height of the sheets uniform.

Figure 16A:
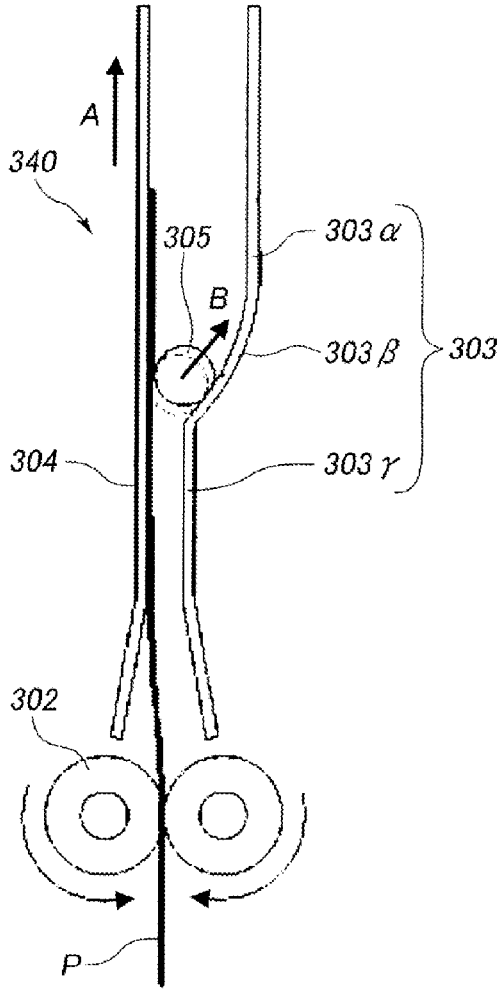
FIGS. 16A and 16B are diagrams illustrating the sheet holding portion according to the second exemplary embodiment.
Figure 16B:
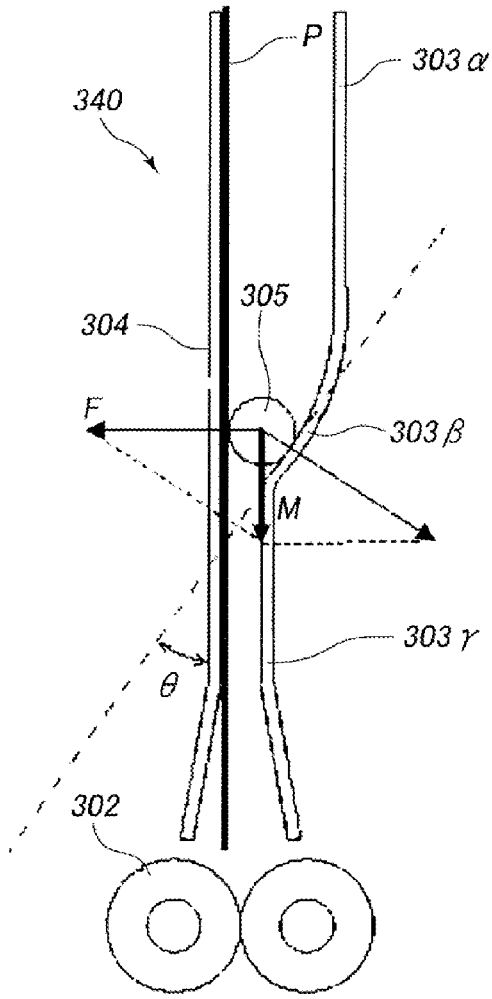

Next, a holding operation for holding the sheet P in the sheet holding portion 340 will be described with reference to FIGS. 16A to 17B. First, an operation of holding a piece of sheet will be described with reference to FIGS. 16A and 16B. FIG. 16A illustrates a state where the holding member 305 is moved by the sheet P passing through the sheet holding portion 340. FIG. 16B illustrates a state where the sheet P is nipped by the storing guide 304 and the holding member 305.

When the sheet P is conveyed into the sheet storing portion 330 by the conveying roller 301, as shown in FIG. 16A, the holding member 305 of the sheet holding portion 340 is pushed by the sheet P passing through the nip portion (abut portion) between the storing guide 304 and the holding member 305. When the holding member 305 is pushed by the sheet P, the holding member 305 moves (goes up) in a direction of arrow B along the curved surface portion 303β by the thickness of the sheet P. As a result, the sheet P can pass through the sheet holding portion 340.

Next, when the sheet P has passed through the conveying roller 301, the conveying roller 301 no longer applies the convey force to the sheet P and thus the pushing by the sheet P with respect to the holding member 305 is released. When the pushing by the sheet P with respect to the holding member 305 is released, the holding member 305 comes down due to its weight and is nipped between the storing guide 304 (the sheet P) and the curved surface portion 303β. At this time, as shown in FIG. 16B, abutment force F (=M/tan θ) as the biasing force toward the storing guide 304 acts on the sheet P, due to gravity M acting on the holding member 305. As a result, the sheet P is nipped by the storing guide 304 and the holding member 305 due to the abutment force F acting as the wedge effect. That is to say, the sheet P is held.

Figure 17A:
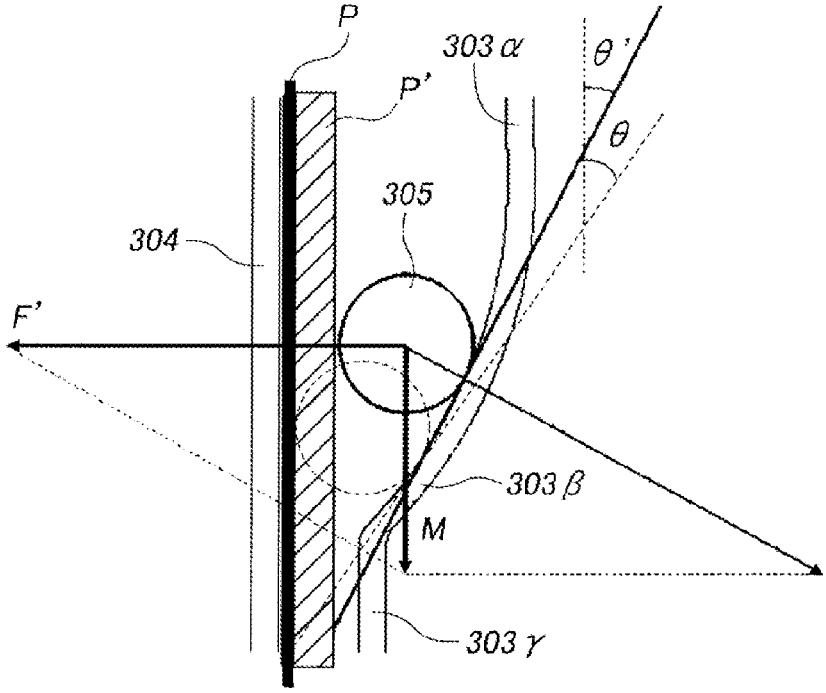
FIGS. 17A and 17B are diagrams describing a function of a holding member according to the second exemplary embodiment.
Figure 17B:
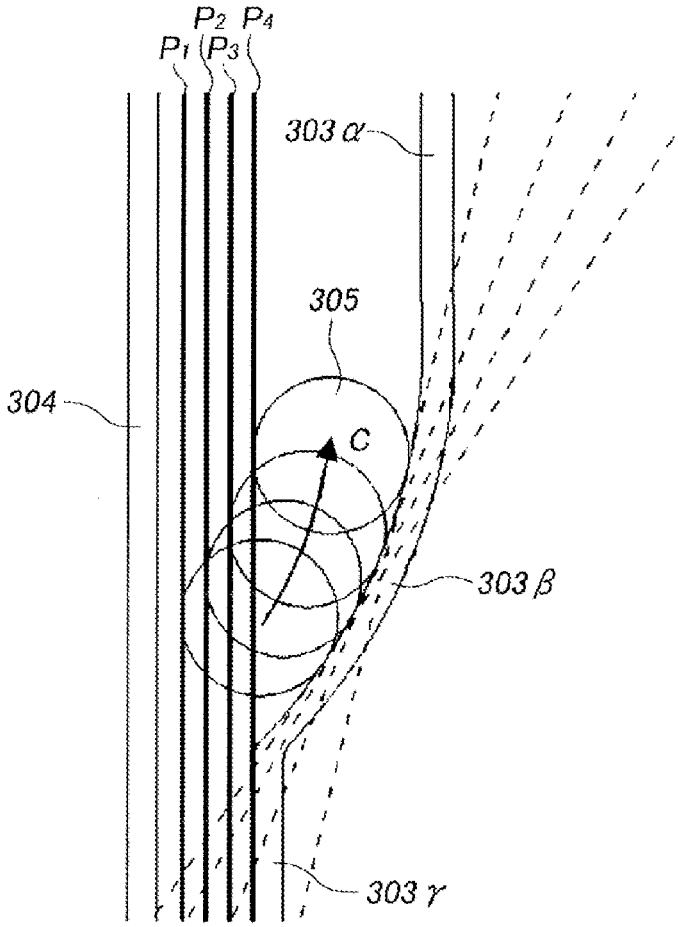

Next, change in the abutment force F of the holding member 305 in a case where a plurality of sheets is held will be described based on the sheet holding operation with reference to FIGS. 17A and 17B. FIG. 17A illustrates a state where the holding member 305 moves when a sheet P' having a thickness different from that of the sheet P is held. FIG. 17B illustrates a state where the holding member 305 moves when a plurality of sheets P1, P2, P3 and P4 is held.

First, the change in the abutment force F in the case where the sheet P' having a thickness different from that of the sheet P is held will be described with reference to FIG. 17A. As described above, when the sheet P is held by the holding member 305, the abutment force F (=M/tan θ) acts on the sheet P due to the gravity M acting on the holding member 305. Then, the sheet P' is conveyed by the conveying roller 301. In this case, the holding member 305 is pushed by the sheet P' passing through the nip portion (abut portion) between the storing guide 304 and the holding member 305 and goes up in a direction of arrow B along the curved surface portion 303β by the thickness of the sheet P'.

Next, when the sheet P' has passed through the conveying roller 301, the conveying roller 301 no more applies the convey force to the sheet P' and thus the pushing by the sheet P' with respect to the holding member 305 is released. As a result, the sheet P' is nipped by the storing guide 304 and the holding member 305 as shown in FIG. 17A. At this time, the abutment force F' (=M/tan θ') toward the storing guide 304 acts on the sheet P and the sheet P' due to the gravity M acting on the holding member 305.

Here, the holding member 305 is located at a higher position as compared with the case where only the sheet P is nipped. Meanwhile, the curved surface portion 303β is adapted such that the inclination angle with respect to the guide surface 304*a* becomes smaller in the upward direction. Therefore, the inclination angle θ' at the abut portion with respect to the curved surface portion 303β when the sheet P' is nipped is smaller than the inclination angle θ at the abut portion with respect to the curved surface portion 303β when the sheet P is nipped. As a result, the abutment force F' becomes "tan θ'/tan θ'" times stronger than the abutment force F, and thus the abutment force F' stronger than the abutment force F acts on the sheet P and the sheet P'. That is to say, as a total thickness of the sheets held becomes larger, the holding member 305 is more apart from the guide surface 304*a*, the inclination angle θ of the curved surface portion 303β at a position with which the holding member 305 abuts becomes smaller and thus the force acting on the held sheets becomes stronger.

Next, the change in the abutment force F in the case where the plurality of sheets P1, P2, P3 and P4 is held will be described with reference to FIG. 17B. As described above, when the sheet P1 is held by the holding member 305, the abutment force F1 (=M/tan θ1) acts on the sheet P1 due to the gravity M acting on the holding member 305. After that, the sheets P2 to P4 are held in order. Since the number of sheets P held is increased, the holding member 305 is more apart from the guide surface 304*a*, the inclination angle θ of the curved surface portion 303β at a position with which the holding member 305 abuts becomes smaller and thus the force acting on the held sheets becomes stronger.

Let us consider a sheet Pi and a subsequent sheet Pi+1. Here, "i" represents a number of the order of the conveyed sheet P. When the subsequent sheet Pi+1 is inserted to the nip portion between the holding member 305 and the sheet Pi, the total thickness of the sheet bundle being held is increased by a thickness of the inserted sheet Pi+1. Therefore, the holding member 305 moves in the upward direction (i.e. toward downstream in the conveying direction) in response to the increase in the thickness. By successively performing this operation, the holding member 305 successively moves in the upward direction (i.e. a direction of arrow C illustrated in FIG. 17B). Due to the upward movement of the holding member 305, the abutment force F is increased and thereby the bundle of sheets P can be held by appropriate force.

Third Exemplary Embodiment

Next, an image forming apparatus 100A according to a third exemplary embodiment of the present invention will be described with reference to FIGS. 18 to 24. Description related to FIG. 1 is incorporated herein. The image forming apparatus 100A according to the third exemplary embodiment is different in a sheet storing portion 330A of a sheet storing apparatus 300A from the foregoing first and second exemplary embodiment. Therefore, the difference from the first and second exemplary embodiments, namely, the sheet storing portion 330A will be mainly described in the third exemplary embodiment. The same reference numerals are given to the same components as those described in the first and second exemplary embodiments, and an overlapping description will be omitted as appropriate. It should be noted that the same configuration in the third exemplary embodiment as that described in the first and second exemplary embodiments provides the same effects as in the first and second exemplary embodiments.

Figure 18:
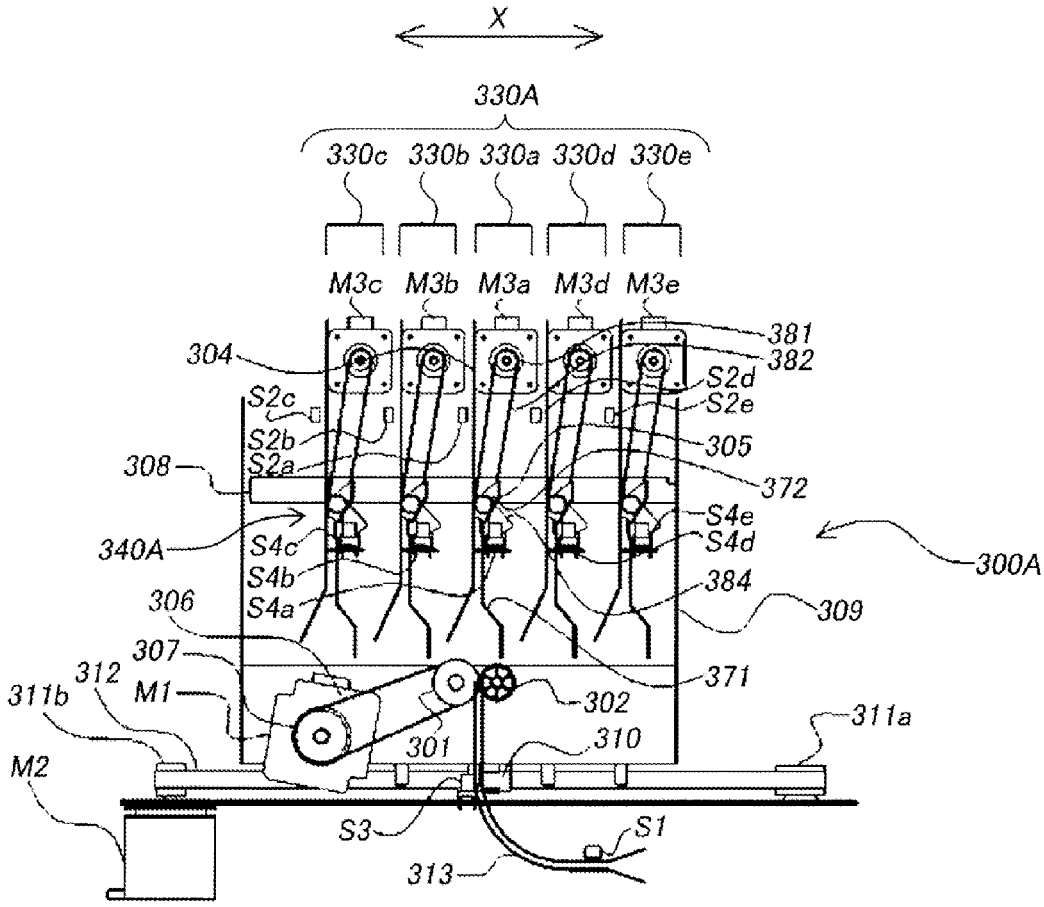
FIG. 18 is a cross-sectional view illustrating a sheet storing apparatus of an image forming apparatus according to a third exemplary embodiment.
Figure 19:
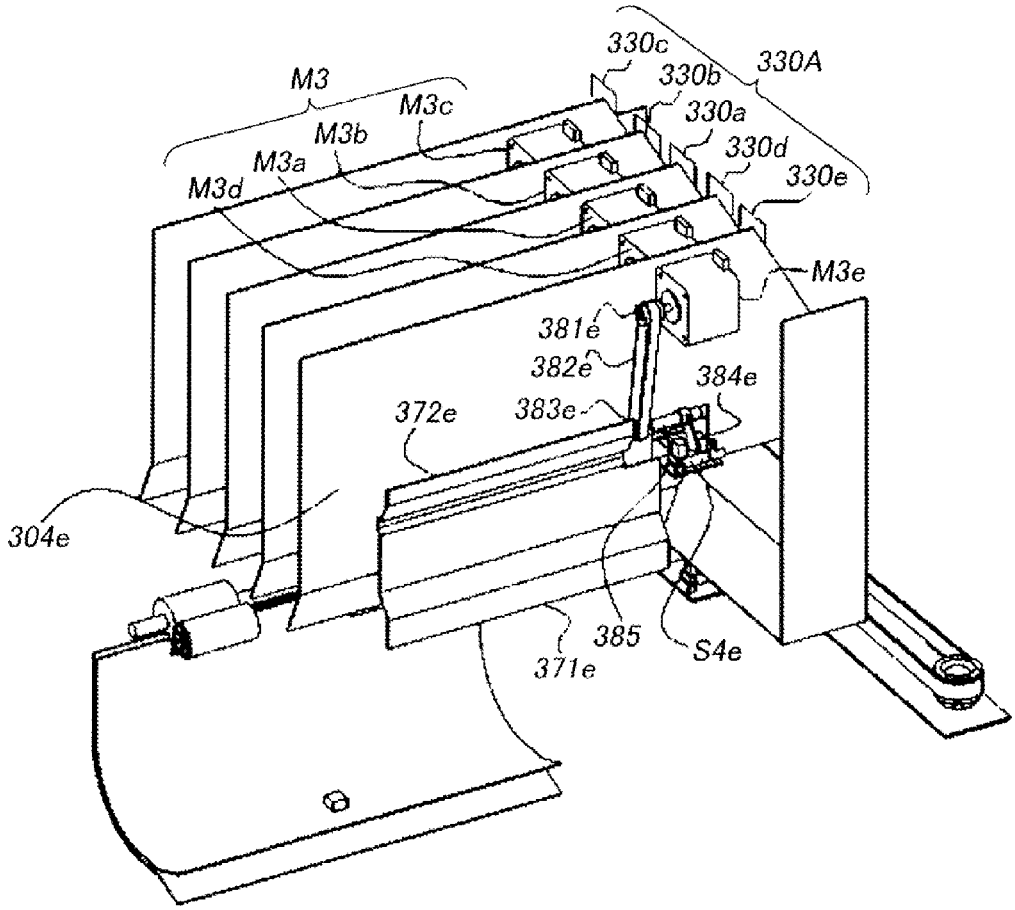
FIG. 19 is a perspective view illustrating a sheet storing portion of the sheet storing apparatus according to the third exemplary embodiment.
Figure 20A:
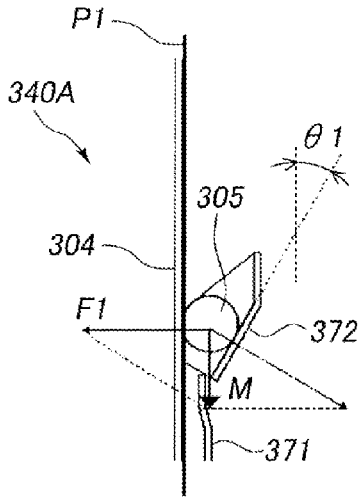
FIGS. 20A to 20C are diagrams illustrating an operation of a conveying guide according to the third exemplary embodiment.
Figure 20B:
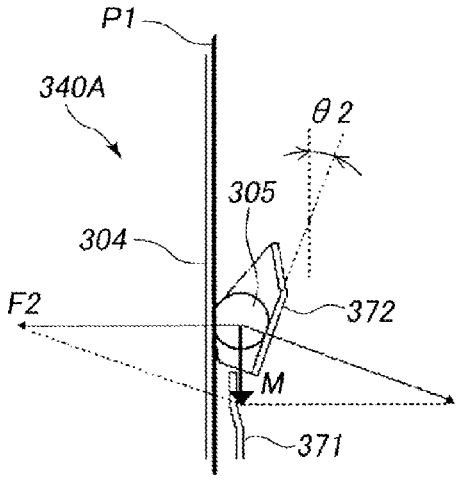
Figure 20C:
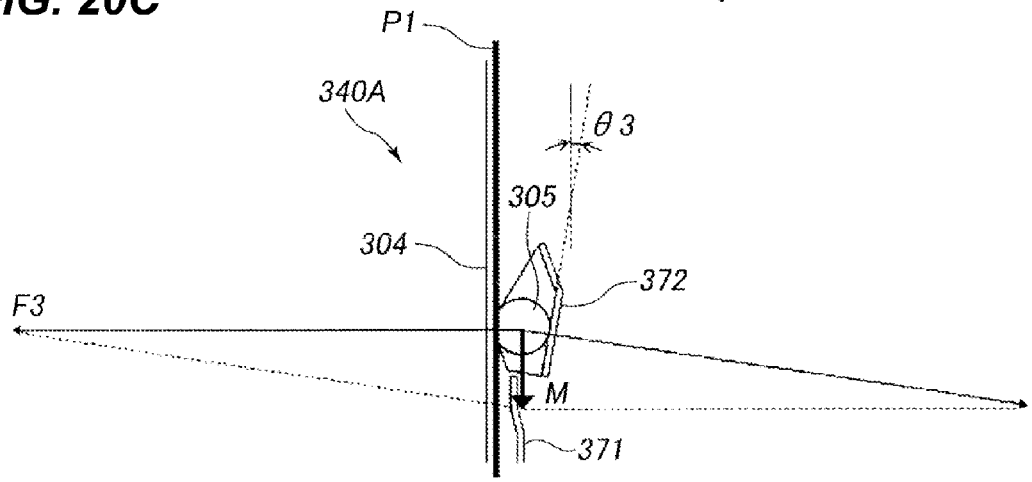

A schematic configuration of the sheet storing portion 330A according to the third exemplary embodiment will be described with reference to FIGS. 18 to 20C. FIG. 18 is a cross-sectional view illustrating the sheet storing apparatus 300A of the image forming apparatus 100A according to the third exemplary embodiment. FIG. 19 is a perspective view illustrating the sheet storing portion 330A of the sheet storing apparatus 300A according to the third exemplary embodiment. FIG. 20A illustrates a state where a holding guide 372 is inclined at an angle of θ1 degree. FIG. 20B illustrates a state where the holding guide 372 is inclined at an angle of θ2 degree. FIG. 20C illustrates a state where the holding guide 372 is inclined at an angle of θ3 degree. The sheet storing portion 330A has the plurality of sheet storing portions 330*a* to 330*e*. It should be noted that the plurality of sheet storing portions 330*a* to 330*e* each has the same configuration and they may be referred to as the sheet storing portion 330A in the following description.

As shown in FIG. 18, the sheet storing portion 330A has a sheet holding portion 340A, a guide movement motor M3, a movement pulley 381, a movement pulley 383, a timing belt 382, a guide position detecting sensor S4 and a guide position detecting sensor flag 384.

As shown in FIGS. 19 and 20A, the sheet holding portion 340A has the storing guide 304, the holding member 305, a holding guide 372 and a conveying guide 371. The holding guide 372 is provided to face the guide surface 304*a* of the storing guide 304. The holding member 305 is supported together by the holding guide 372 and the storing guide 304. Moreover, a guide movement rotating shaft 385 is connected to the holding guide 372, and the holding guide 372 is adapted to be rotatable around the guide movement rotating shaft 385 as a rotating center.

The movement pulley 381 is provided on a rotating shaft of the guide movement motor M3, the movement pulley 383 is provided on a rotating shaft of the guide movement rotating shaft 385, and the timing belt 382 is winded between the movement pulley 381 and the movement pulley 383. The guide movement motor M3 serves as a driving source and the driving force is transmitted to the holding guide 372 by the timing belt 382 winded between the movement pulley 381 and the movement pulley 383. As a result, the holding guide 372 is driven to rotate around the guide movement rotating shaft 385 as the rotating center. That is to say, a relative angle of the holding guide 372 with respect to the guide surface 304*a* of the storing guide 304 becomes adjustable.

The guide position detecting sensor flag 384 is provided on the guide movement rotating shaft 385. A home position of the holding guide 372 is detected by the guide position detecting sensor S4 corresponding to the guide position detecting sensor flag 384. A position of the holding guide 372 with respect to the home position can be determined based on the number of driving pulses of the guide movement motor M3.

Next, a holding operation for holding the sheet P in the sheet holding portion 330 will be described with reference to FIGS. 20A to 20C. It should be noted that the holding operation for the sheet P is similar to that described in the first exemplary embodiment and the detailed description will be omitted here. As shown in FIG. 20A, the holding member 305 abuts with the holding guide 372, and the gravity acting on the holding member 305 generates the abutment force F1 acting in a direction toward the storing guide 304. Due to the abutment force F1, a sheet P1 is held between the storing guide 304 and the holding member 305.

According to the third exemplary embodiment, sheets are conveyed successively, and every time the number of sheets held by the storing guide 304 and the holding member 305 reaches a specified number, the holding guide 372 is rotated such that the inclination angle θ at the abut portion of the holding member 305 and the holding guide 372 becomes smaller. More specifically, as shown in FIG. 20A, when the sheet P1 is conveyed to the sheet holding portion 340A, the inclination angle of the holding guide 372 is set to θ1. When the inclination angle is set to θ1, the abutment force F1 is applied to the sheet P1 due to the gravity acting on the holding member 305 and thereby the sheet P1 is held.

Next, when a sheet P2 is conveyed to the sheet holding portion 340A, as shown in FIG. 20B, a total thickness of the sheet bundle held becomes (P1+P2). In this case, the holding guide 372 is rotated such that the inclination angle is set to θ2 (θ2>θ1). As a result, the abutment force F2 (F2>F1) is applied to the sheets P1 and P2 and thus the sheets P1 and P2 can be appropriately held.

Furthermore, when a sheet P3 is conveyed to the sheet holding portion 340A, as shown in FIG. 20C, a total thickness of the sheet bundle held becomes (P1+P2+P3). In this case, the holding guide 372 is rotated such that the inclination angle is set to θ3 (θ3>θ2). As a result, the abutment force F3 (F3>F2) is applied to the sheets P1 to P3 and thus the sheets P1 to P3 can be appropriately held.

Figure 21:
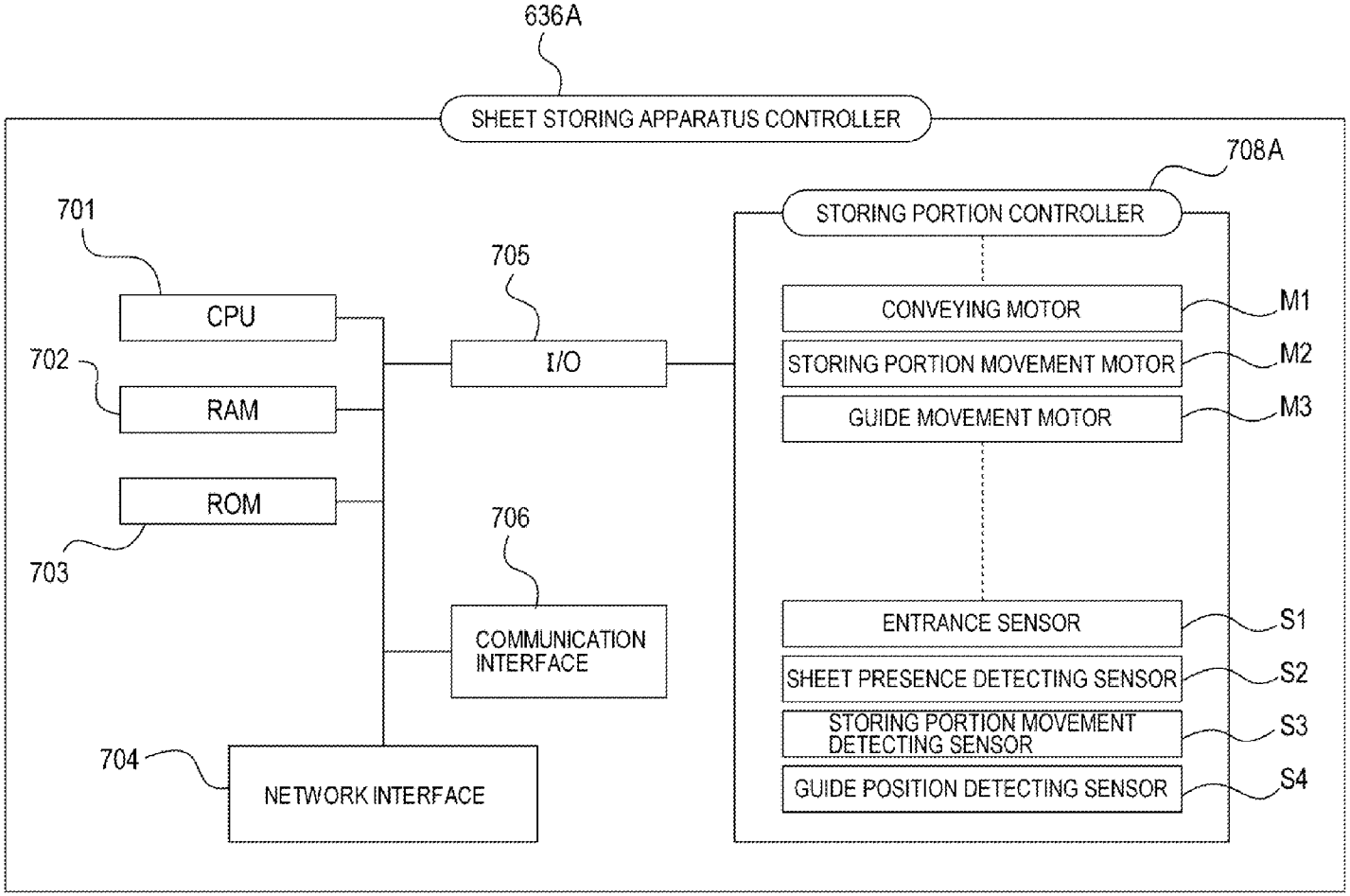
FIG. 21 is a control block diagram illustrating a sheet storing apparatus controller for controlling the sheet storing apparatus according to the third exemplary embodiment.

Next, a sheet storing apparatus controller 636A for controlling the sheet storing apparatus 300A according to the third exemplary embodiment will be described with reference to FIG. 21. FIG. 21 is a control block diagram of the sheet storing apparatus controller 636A for controlling the sheet storing apparatus 300A according to the third exemplary embodiment.

As shown in FIG. 21, the sheet storing apparatus controller 636A has the CPU 701, the RAM 702, the ROM 703, a storing portion controller 708A and on the like. The sheet storing apparatus controller 636A communicates with the CPU circuit portion 630 provided in the copy machine body 130 through the communication interface 706 to exchange data. Moreover, the sheet storing apparatus controller 636A executes various programs stored in the ROM 703 in accordance with instructions from the CPU circuit portion 630 to control an operation the sheet storing apparatus 300 through the storing portion controller 708A.

For example, when sheet storing processing control is performed, detection signals from various sensors for controlling the operation of the sheet storing apparatus 300 are transmitted from the storing portion controller 708A to the CPU 701 through the I/O 705. The various sensors include the entrance sensor S1, the sheet presence detecting sensor S2, the storing portion movement detecting sensor S3 and the guide position detecting sensor S4 described above. The CPU 701 drives the conveying motor M1, the storing portion movement motor M2 and the guide movement motor M3 described above through the storing portion controller 708.

Figure 22:
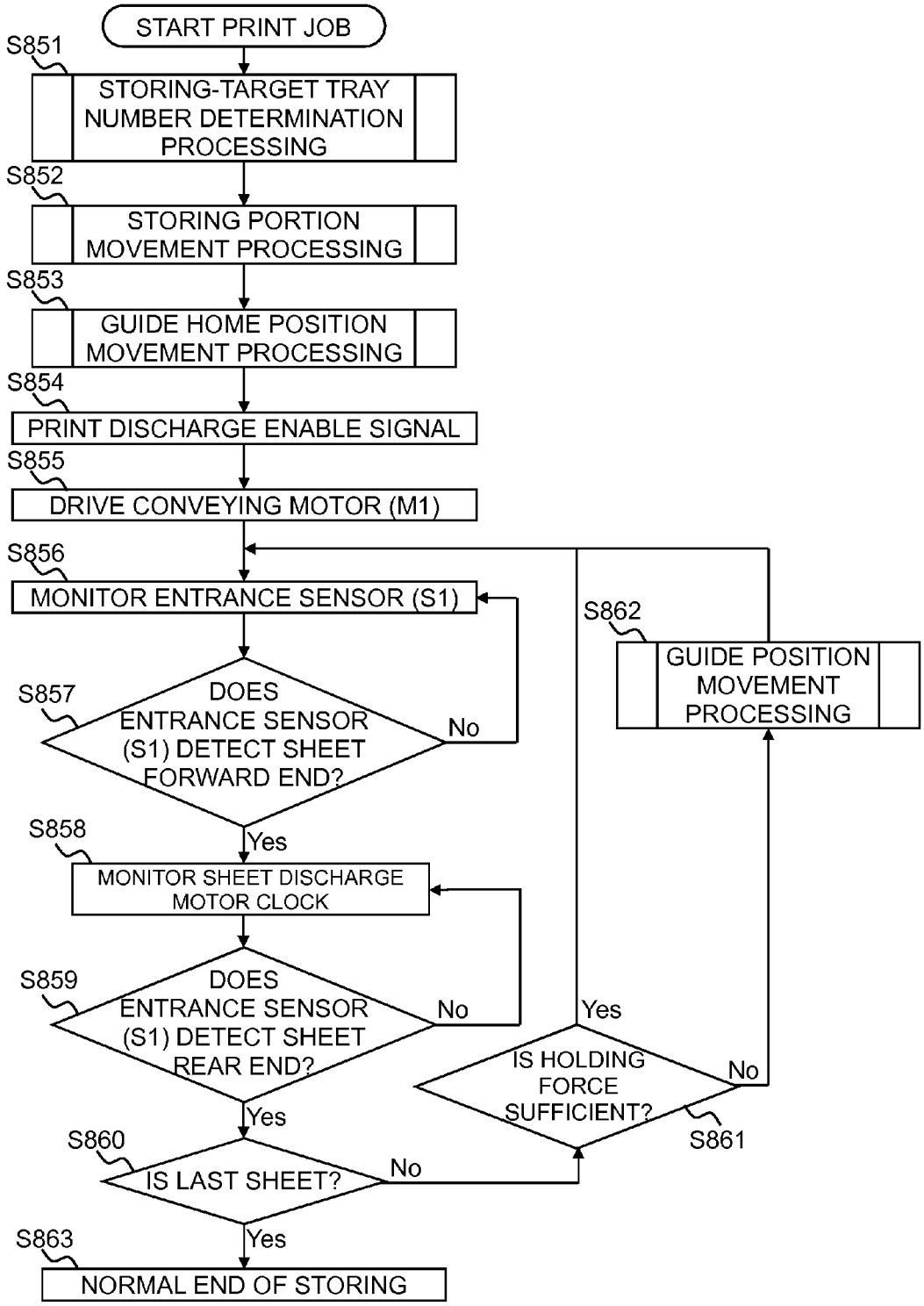
FIG. 22 is a flow chart showing sheet storing operation control by the sheet storing apparatus according to the third exemplary embodiment.
Figure 23:
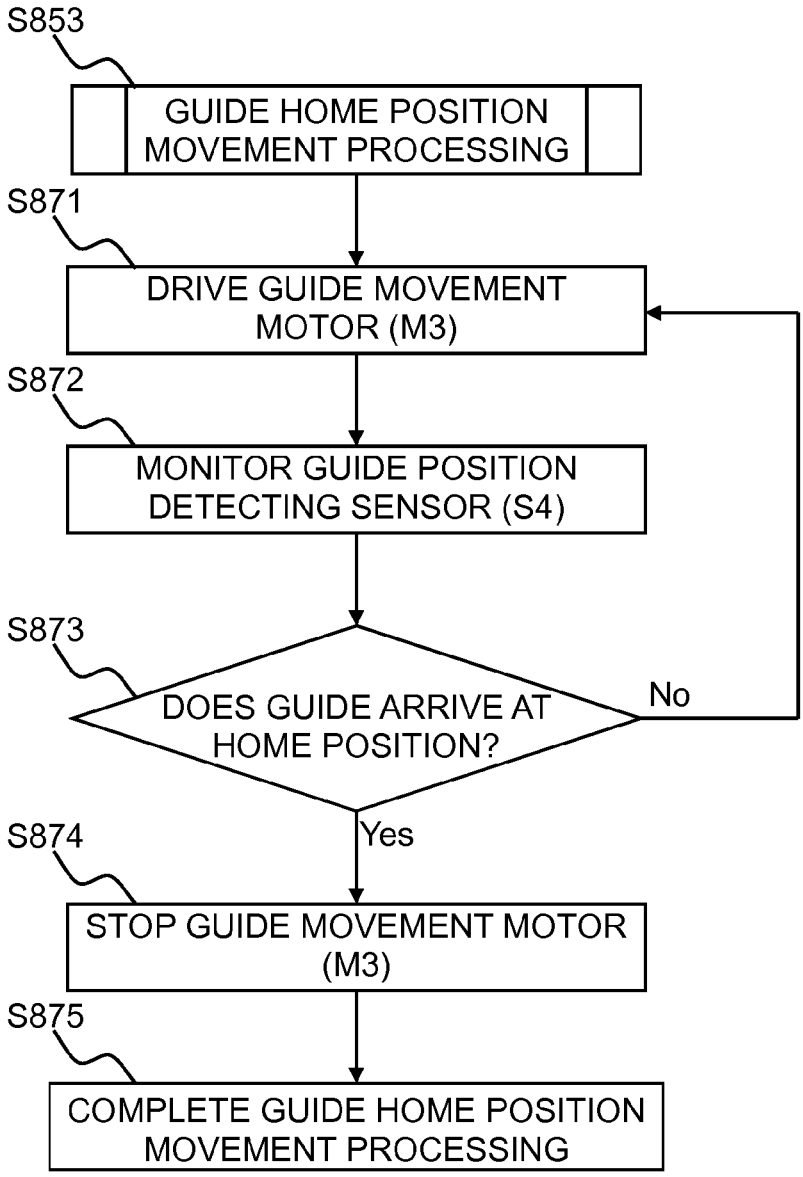
FIG. 23 is a flow chart showing guide home position movement processing by the sheet storing apparatus according to the third exemplary embodiment.
Figure 24:
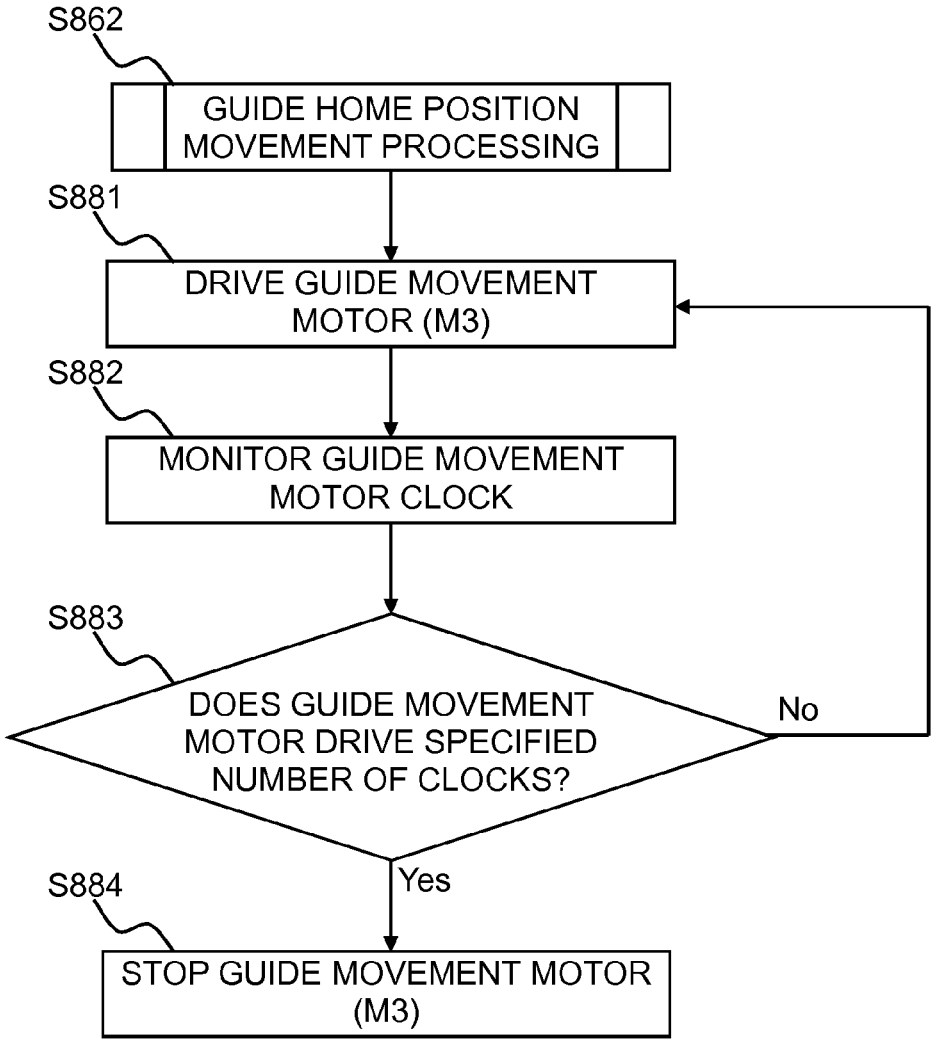
FIG. 24 is a flow chart showing guide position movement processing by the sheet storing apparatus according to the third exemplary embodiment.

Next, sheet storing operation control by the sheet storing apparatus 300A according to the third exemplary embodiment will be described with reference to FIGS. 22 to 24. FIG. 22 is a flow chart showing the sheet storing operation control by the sheet storing apparatus 300A according to the third exemplary embodiment. FIG. 23 is a flow chart showing guide home position movement processing by the sheet storing apparatus 300A according to the third exemplary embodiment. FIG. 24 is a flow chart showing guide position movement processing by the sheet storing apparatus 300A according to the third exemplary embodiment.

As shown in FIG. 22, when a print job is submitted to the image forming apparatus 100A, the print job is started. In response to that, the sheet storing apparatus controller 636A first performs storing-target tray number determination processing (S851). It should be noted that the storing-target tray number determination processing (S851) is the same as that described in the first exemplary embodiment and its description is omitted here. After the storing-target tray number determination processing (S851) is completed, storing portion movement processing is performed (S852). It should be noted that the storing portion movement processing (S852) is the same as that described in the first and second exemplary embodiments and its description is omitted here.

Next, when the storing portion movement processing (S852) is completed, the flow proceeds to the guide home position movement processing (S853) and a process of moving the holding guide 372 to its home position is executed. As shown in FIG. 23, in the guide home position movement processing (S853), the guide movement motor M3 is driven and whether or not the holding guide 372 is moved to the guide home position is detected by the guide position detecting sensor S4 (S871 to S872). When the movement of the holding guide 372 to the guided home position is completed, the operation of the guide movement motor M3 is stopped and then the guide home position movement processing is completed (S873, S874). The subsequent processing from the output of the print discharge enable signal to the detection of the rear end portion of the sheet P by the entrance sensor S1 is the same as that described in the first and second exemplary embodiments (S854 to S859).

After that, whether or not the sheet P passing through the entrance sensor S1 is the final sheet is determined (S860). If the sheet P is the final sheet, it is determined that the sheet removal processing is normally completed (S863) and the print job is ended. On the other hand, if the sheet P is not the final sheet, it is determined whether or not the holding force is sufficient to hold the sheet bundle as the holding target including the target sheet, a sheet to be conveyed next and the existing held sheet (S861). If the holding force is determined to be sufficient, the flow returns back to the detection of the forward end of the sheet to be conveyed next (S857) and thereafter the same processing is repeated.

On the other hand, if the holding force is determined to be insufficient, the guide position movement processing (S862) is performed. As shown in FIG. 24, in the guide position movement processing (S862), the guide movement motor M3 is driven and the number of clocks of the guide movement motor M3 is monitored (S881 to S882). Then, if the monitored number reaches a predetermined number of clocks, the guide movement motor M3 is stopped. In this manner, the position of the holding guide 372 is changed. Then, the guide position movement processing (S862) is completed. When the guide position movement processing (S862) is completed, the flow returns back to the detection of the forward end of the sheet to be conveyed next (S857) and thereafter the same processing is repeated.

According to the third exemplary embodiment, as described above, the holding guide 372 is adapted to be rotatable. Therefore, the inclination angle of the holding guide 372 can be set depending on sheet information such as the number of held sheets and the total thickness of held sheets. It is therefore possible to increase degree of freedom of the maximum number of sheets or the maximum thickness of sheets that can be held.

Although the exemplary embodiments of the present invention have been described above, the present invention is not limited to the exemplary embodiments described above. Moreover, the effects listed in the exemplary embodiments of the present invention are simply some preferred effects obtained by the present invention, and the effects according to the present invention are not limited to those described in the exemplary embodiments of the present invention.

For example, the storing guide 304 is provided in a substantially vertical state in the present exemplary embodiment. However, the present invention is not limited to that. For example, the guide surface 304*a* of the storing guide 304 may be formed to be inclined within −45 to +45 degrees angle from the vertical direction.

Moreover, in the present exemplary embodiment, the five sheet storing portions 330 (330*a* to 330*e*) each has the same configuration and is referred to as the sheet storing portion 330. However, the present invention is not limited to that. For example, the respective sheet holding portions 340 of the five sheet storing portions 330 (330*a* to 330*e*) may be provided with the curved surface portions 303β which are different from each other in the inclination angle. In this case, an optimum sheet holding portion 340 for holding (nipping) the sheet can be selected depending on the sheet information.

Moreover, in the third exemplary embodiment, the inclination angle of the holding guide 372 is changed depending on the number of the held sheets P. However, the present invention is not limited to that. For example, the inclination angle of the holding guide 372 may be changed depending on sheet information such as a thickness of the sheet P, a basis weight of the sheet P, a size of the sheet P and weight of the sheet P.

Moreover, the following configuration also is possible. That is, the sheet information is input by the operation portion 601 provided on the top surface of the sheet storing apparatus 300, and an optimum inclination angle is determined based on the input sheet information and a table that is beforehand stored, and then the determined inclination angle is set.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-130512, filed Jun. 10, 2011, No. 2011-133567, filed Jun. 15, 2011, and No. 2012-110524, filed May 14, 2012, which are hereby incorporated by reference herein in their entirety.

What is claimed is:

1. A sheet storing apparatus comprising:

a sheet conveying portion configured to convey a sheet; and a sheet holding portion located above the sheet conveying portion and configured to receive a sheet conveyed by the sheet conveying portion from below and to hold the received sheet in a vertical state, wherein the sheet holding portion comprises:

a first guide member provided in a vertical state and having a guide surface configured to guide the received sheet upward;

a second guide member provided facing the guide surface of the first guide member and having an inclined portion, wherein a gap between the guide surface and the inclined portion increases in an upward direction; and a rolling member provided between the guide surface of the first guide member and the inclined portion of the second guide member and configured to roll on the inclined portion toward the guide surface to nip the received sheet with the guide surface.

2. The sheet storing apparatus according to claim 1, wherein the inclined portion of the second guide member is a planar surface and is fixed with respect to the first guide member.

3. The sheet storing apparatus according to claim 1, wherein an inclination angle of the inclined portion of the second guide member with respect to the guide surface decreases with increasing distance from the guide surface.

4. The sheet storing apparatus according to claim 3, wherein the inclined portion is a curved surface and is fixed relative to the first guide member.

5. The sheet storing apparatus according to claim 3, wherein the inclined portion is fixed relative to the first guide member, and is formed by a plurality of inclined surfaces that are connected one after another such that the inclination angle decreases in a stepwise fashion with increasing distance from the guide surface.

6. The sheet storing apparatus according to claim 1, wherein an angle of tangent at a contact portion between the rolling member and the inclined portion of the second guide member with respect to the guide surface decreases as a distance between the rolling member and the guide surface increases, such that a biasing force of the rolling member toward the guide surface due to gravity increases.

7. The sheet storing apparatus according to claim 1, wherein the second guide member is adapted to be rotatable such that an inclination angle of the inclined portion with respect to the first guide member is adjustable, and wherein the holding portion further comprises a driving portion configured to rotate the second guide member to adjust the inclination angle of the inclined portion.

8. The sheet storing apparatus according to claim 7, further comprising a controller configured to set the inclination angle of the inclined portion based on sheet information of a sheet conveyed by the sheet conveying portion and to control the driving portion such that the set inclination angle is obtained.

9. The sheet storing apparatus according to claim 1, further comprising a sheet displacing portion configured to displace an upstream end in a sheet conveying direction of a preceding sheet to deviate from a downstream end in the sheet conveying direction of a subsequent sheet conveyed to the holding portion subsequent to the preceding sheet.

10. The sheet storing apparatus according to claim 9, wherein the sheet conveying portion is composed of a nip portion of a pair of conveying rollers that are arranged to face each other, and wherein the sheet displacing portion is composed of a periphery of one of the pair of conveying rollers.

11. The sheet storing apparatus according to claim 10, wherein the sheet displacing portion further comprises a plurality of elastic projection portions formed on the periphery of the one conveying roller.

12. The sheet storing apparatus according to claim 9, wherein the sheet conveying portion is composed of a nip portion of a pair of conveying rollers that are arranged to face each other, and wherein the sheet displacing portion is composed of a periphery of one of the pair of conveying rollers and a guide member configured to guide an upstream end in the sheet conveying direction of a sheet conveyed by the nip portion to a side of the one conveying roller.

13. An image forming apparatus comprising:

an image forming apparatus body comprising an image forming portion configured to form an image on a sheet; and a sheet storing apparatus provided above the image forming apparatus body, wherein the sheet storing apparatus comprises:

a sheet conveying portion configured to convey a sheet discharged from the image forming apparatus body; and a sheet holding portion located above the sheet conveying portion and configured to receive a sheet conveyed from below by the sheet conveying portion and to hold the received sheet in a vertical state, wherein the sheet holding portion comprises:

a first guide member provided in a vertical state and having a guide surface configured to guide the received sheet upward;

a second guide member provided facing the guide surface of the first guide member and having an inclined portion, wherein a gap between the guide surface of the first guide member and the inclined portion of the second guide member increases in an upward direction; and a rolling member provided between the guide surface of the first guide member and the inclined portion of the second guide member and configured to roll on the inclined portion toward the guide surface to nip the received sheet with the guide surface.

14. The image forming apparatus according to claim 13, wherein the inclined portion of the second guide member is a planar surface and is fixed relative to the first guide member.

15. The image forming apparatus according to claim 13, wherein an inclination angle of the inclined portion of the second guide member with respect to the guide surface decreases with increasing distance from the guide surface.

16. The image forming apparatus according to claim 15, wherein the inclined portion is a curved surface and is fixed relative to the first guide member.

17. The image forming apparatus according to claim 15, wherein the inclined portion is fixed relative to the first guide member, and is formed by a plurality of inclined surfaces that are connected one after another such that the inclination angle decreases in a stepwise fashion with increasing distance from the guide surface.

18. The image forming apparatus according to claim 13, wherein an angle of tangent at a contact portion between the rolling member and the inclined portion of the second guide member relative to the guide surface decreases as a distance between the rolling member and the guide surface decreases, such that a biasing force of the rolling member toward the guide surface due to gravity increases.

19. The image forming apparatus according to claim 13, wherein the second guide member is configured to be rotatable such that an inclination angle of the inclined portion with respect to the first guide member is adjustable, and wherein the holding portion further comprises a driving portion configured to rotate the second guide member to adjust the inclination angle of the inclined portion.

20. The image forming apparatus according to claim 19, further comprising a controller configured to set the inclination angle of the inclined portion based on sheet information of a sheet conveyed by the sheet conveying portion and to control the driving portion such that the set inclination angle is obtained.

* * * * *